US008251119B2

(12) United States Patent
Toti

(10) Patent No.: US 8,251,119 B2
(45) Date of Patent: Aug. 28, 2012

(54) CONTROL ROD MECHANISM AND SYSTEM

(76) Inventor: Andrew J. Toti, Modesto, CA (US); Russell L. Hinckley, legal representative, Modesto, CA (US)

( * ) Notice: Subject to any disclaimer, the term of this patent is extended or adjusted under 35 U.S.C. 154(b) by 234 days.

(21) Appl. No.: 12/378,290

(22) Filed: Feb. 11, 2009

(65) Prior Publication Data

US 2009/0288507 A1 Nov. 26, 2009

Related U.S. Application Data

(62) Division of application No. 10/693,263, filed on Oct. 23, 2003, now abandoned.

(51) Int. Cl.
*E06B 9/30* (2006.01)

(52) U.S. Cl. ..... 160/168.1 R; 74/127; 74/89.23

(58) Field of Classification Search ..... 160/168.1 R, 160/168.1 V, 176.1 R, 176.1 V, 170, 171, 160/173 R, 173 V, 177 R, 177 V, 178.1 R, 160/178.1 V; 74/127, 89.23
See application file for complete search history.

(56) References Cited

U.S. PATENT DOCUMENTS

| | | | | |
|---|---|---|---|---|
| 361,227 | A | | 4/1887 | Morgan |
| 383,031 | A | | 5/1888 | Allgoever |
| 407,842 | A | | 7/1889 | Schuermann |
| 1,023,023 | A | | 4/1912 | Leopold |
| 1,838,957 | A | | 12/1931 | Orawiec |
| 2,320,119 | A | | 5/1943 | Burks |
| 2,455,434 | A | | 12/1948 | Mikelson |
| 2,664,126 | A | * | 12/1953 | Mansfield et al. ..... 74/127 |
| 3,364,757 | A | | 1/1968 | Sears |
| 3,656,358 | A | * | 4/1972 | Kopp ..... 74/424.96 |
| 4,282,764 | A | | 8/1981 | Harris |
| 4,759,398 | A | | 7/1988 | Renee |
| 4,817,698 | A | | 4/1989 | Rossini et al. |
| 5,472,035 | A | * | 12/1995 | Biba et al. ..... 160/168.1 R |
| 5,476,132 | A | | 12/1995 | Jacobson |
| 5,787,953 | A | | 8/1998 | Jacobson |
| 6,044,890 | A | | 4/2000 | Renee |
| 6,089,303 | A | * | 7/2000 | Metcalf et al. ..... 160/176.1 R |
| 6,115,884 | A | | 9/2000 | DeJong et al. |
| 6,223,802 | B1 | | 5/2001 | Colson |

* cited by examiner

*Primary Examiner* — William C Joyce
*Assistant Examiner* — Terence Boes
(74) *Attorney, Agent, or Firm* — Philip A. Dalton

(57) ABSTRACT

A reversible control rod mechanism adapted for selectively and repeatedly rotating a shaft bidirectionally and thereby moving an attached load bidirectionally.

15 Claims, 25 Drawing Sheets

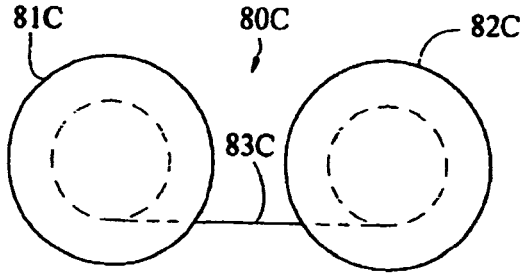
FIG. 8C
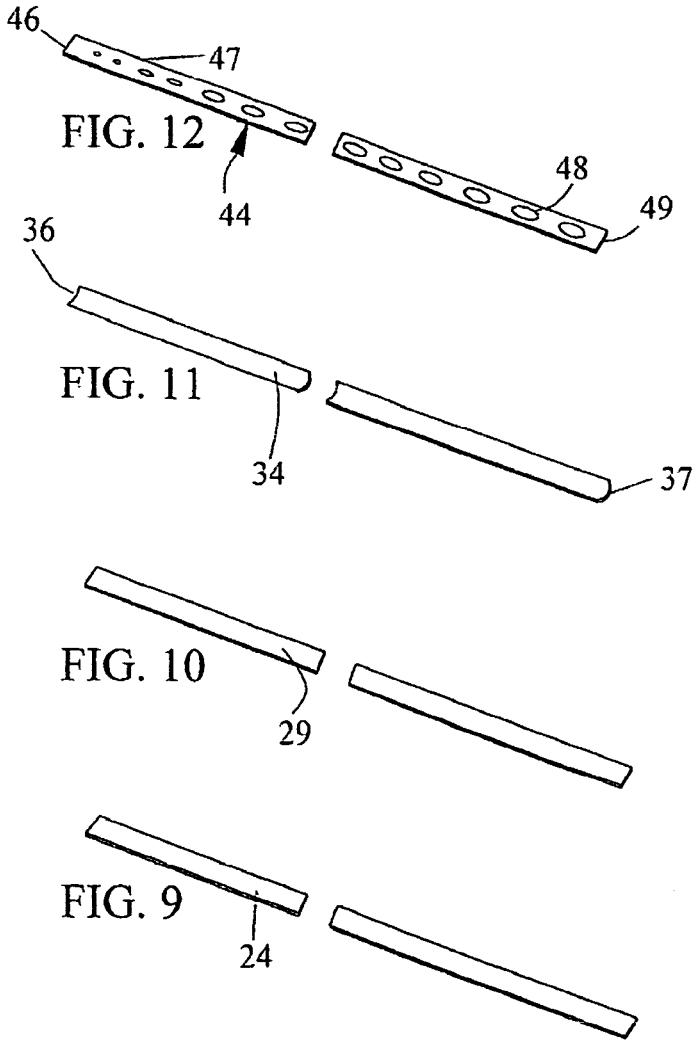

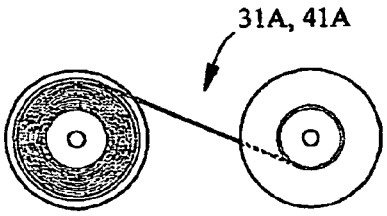
FIG. 14C
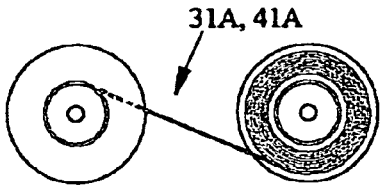
FIG. 14D
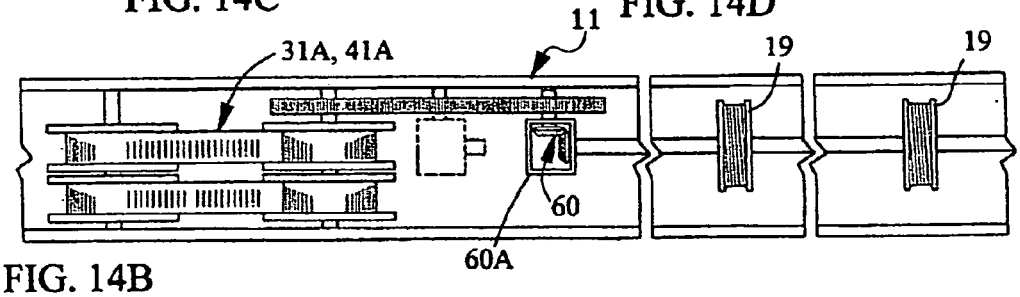
FIG. 14B
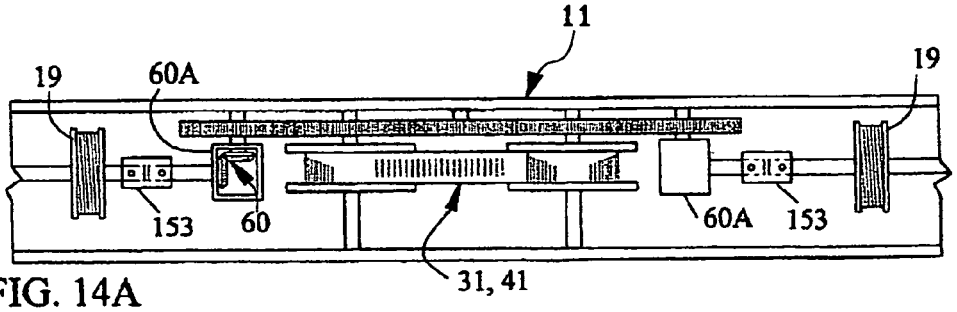
FIG. 14A
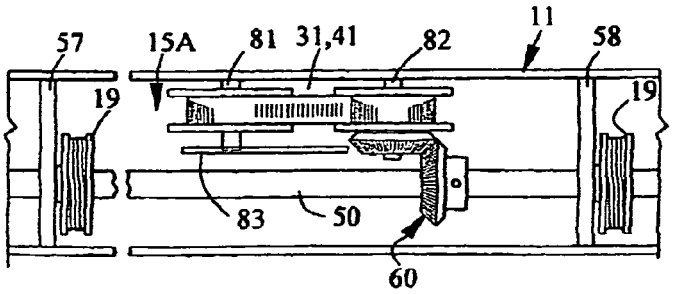
FIG. 14
FIG. 13
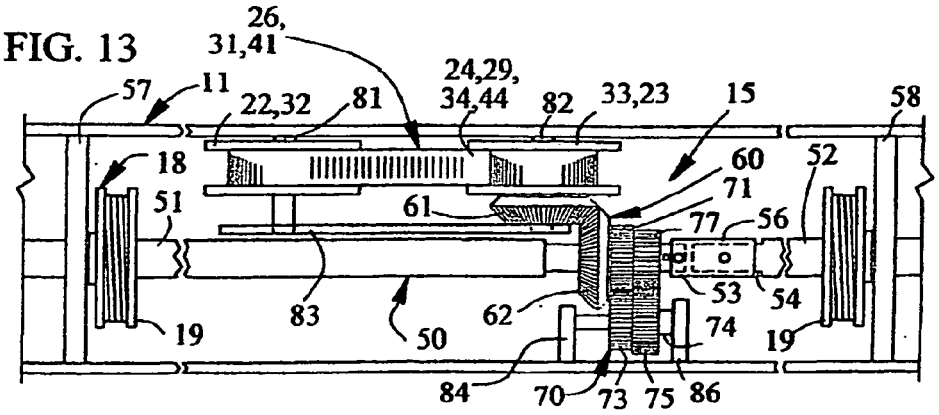

FIG. 21
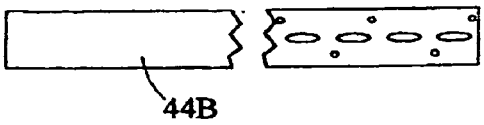
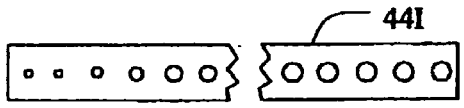
FIG. 28
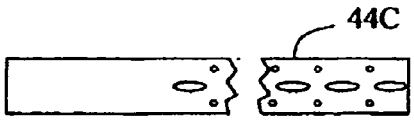
FIG. 22
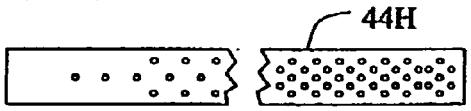
FIG. 27
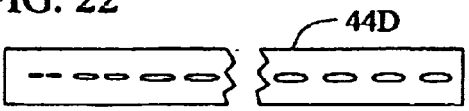
FIG. 23
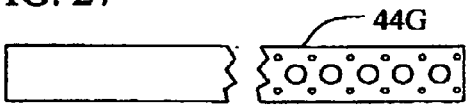
FIG. 26
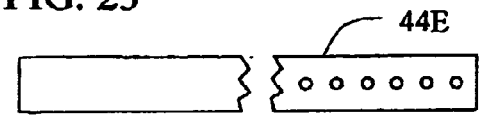
FIG. 24
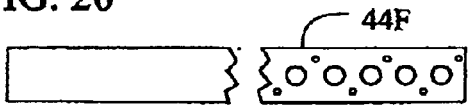
FIG. 25
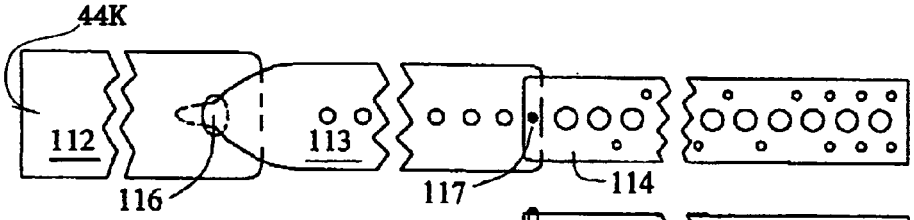
FIG. 29
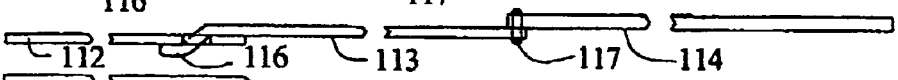
FIG. 30
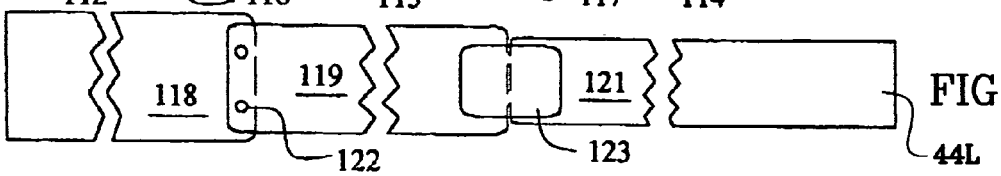
FIG. 31
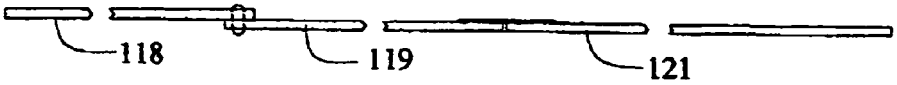
FIG. 32
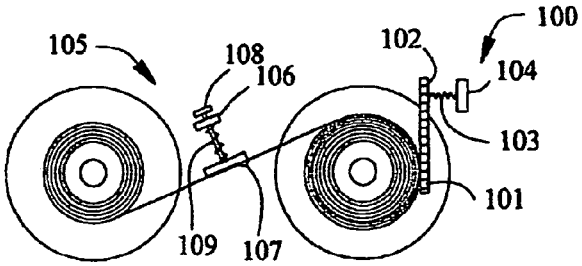
FIG. 33

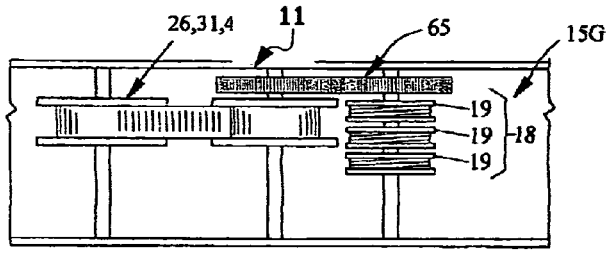
FIG. 38
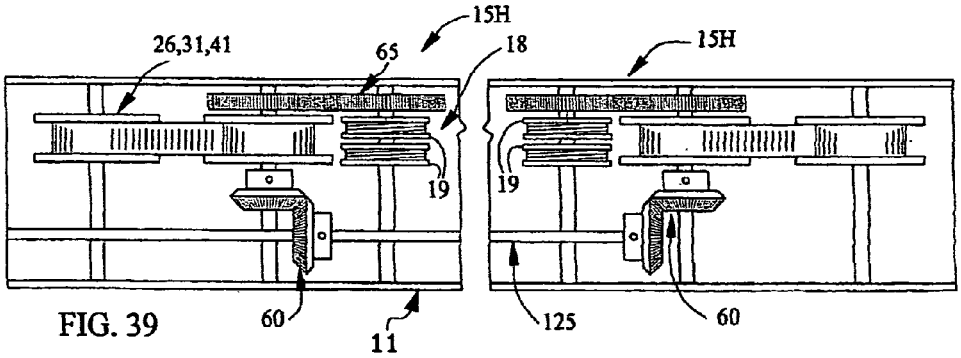
FIG. 39
FIG. 39A
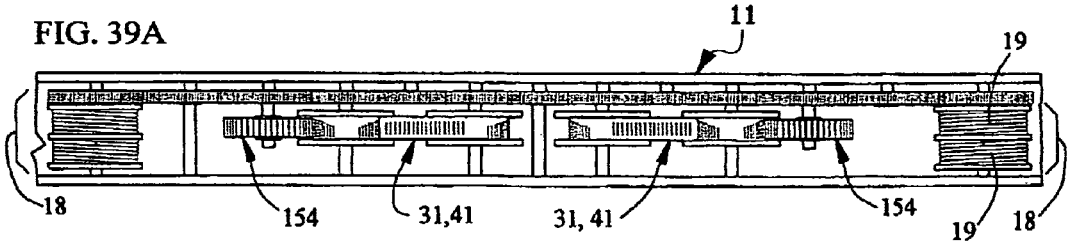

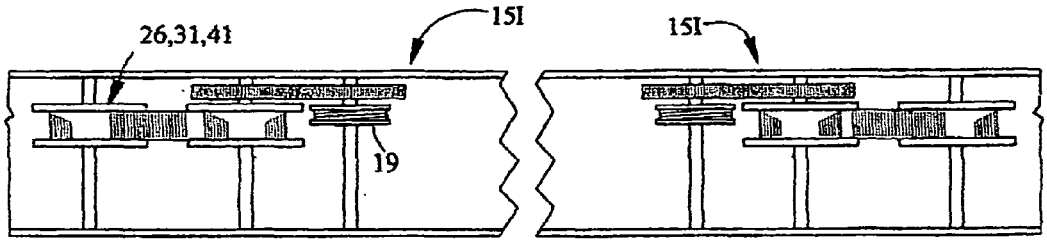
FIG. 40
FIG. 40A
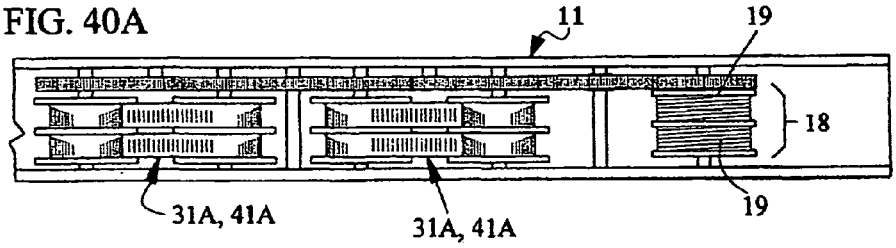
FIG. 41
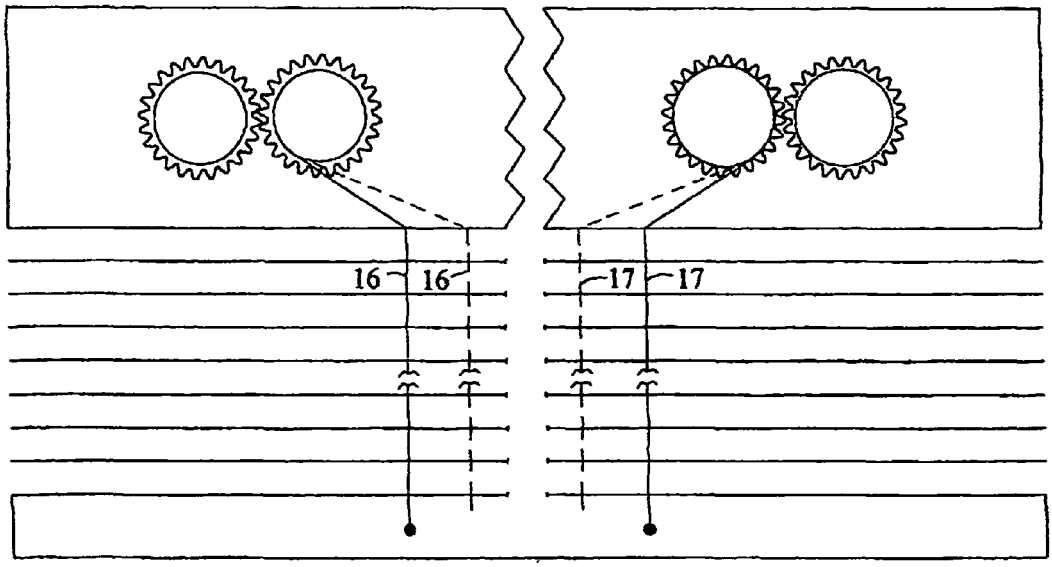

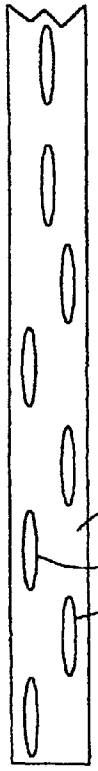
FIG. 42
FIG. 42A
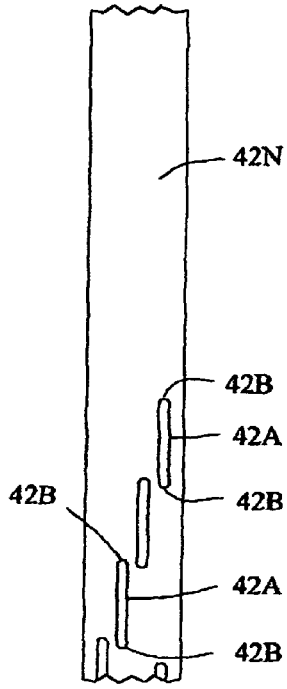
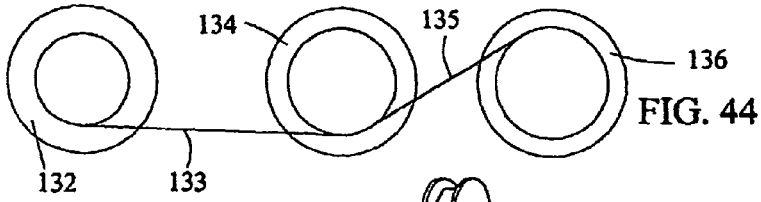
FIG. 44
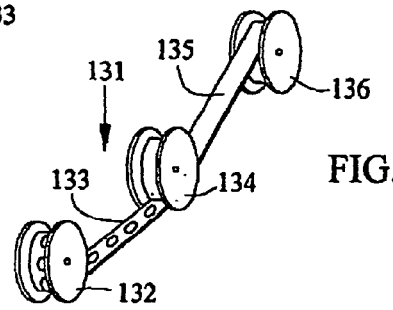
FIG. 43

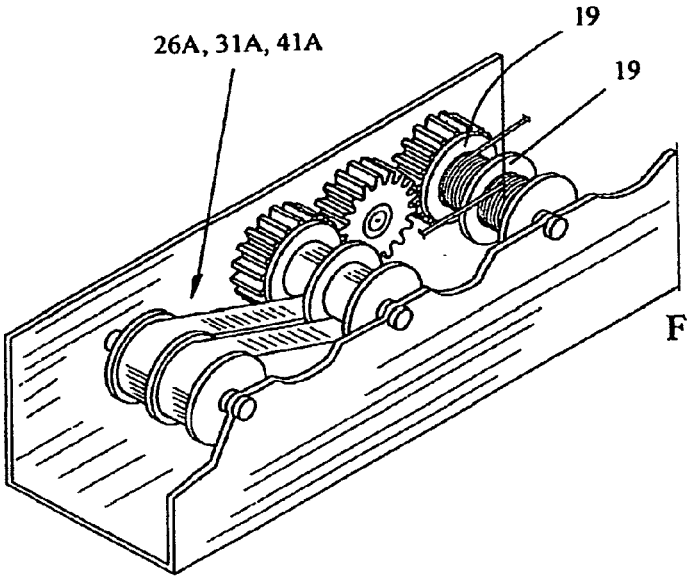
FIG. 49
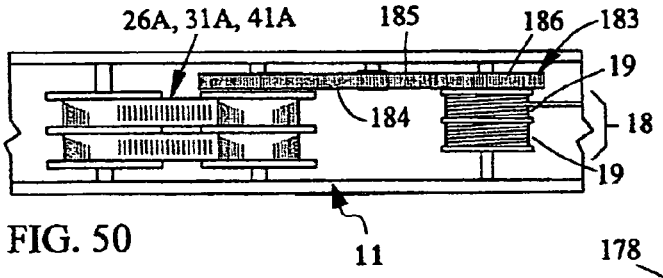
FIG. 50
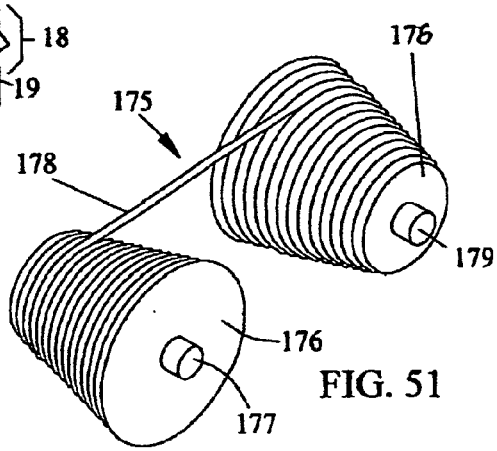
FIG. 51
FIG. 52
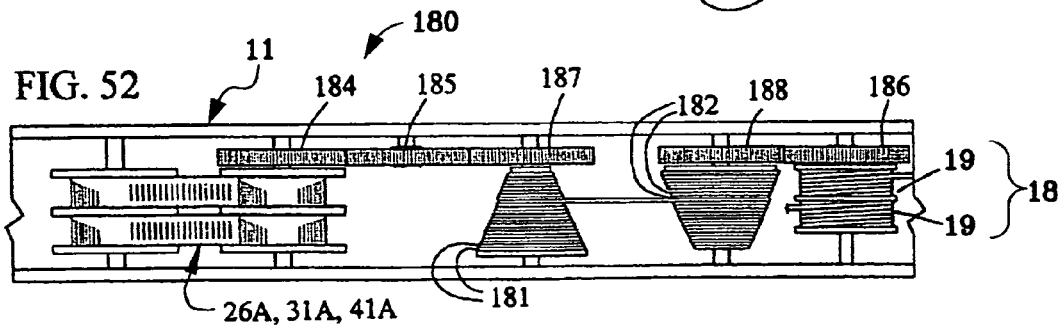

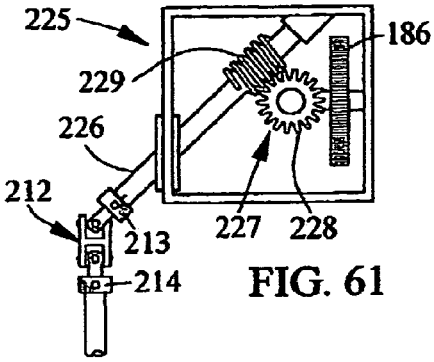
FIG. 61
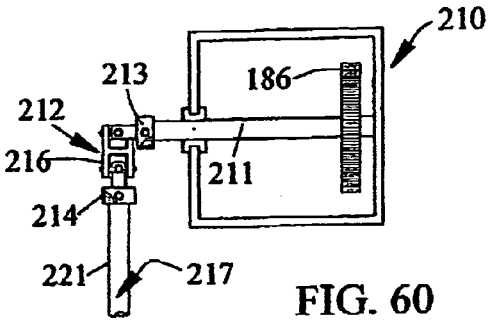
FIG. 60
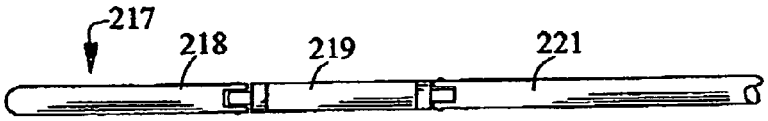
FIG. 62
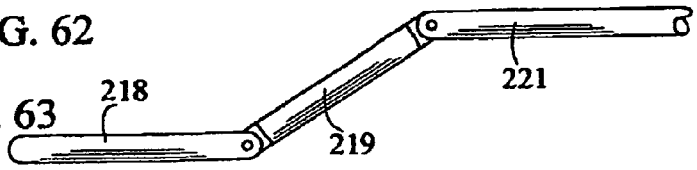
FIG. 63
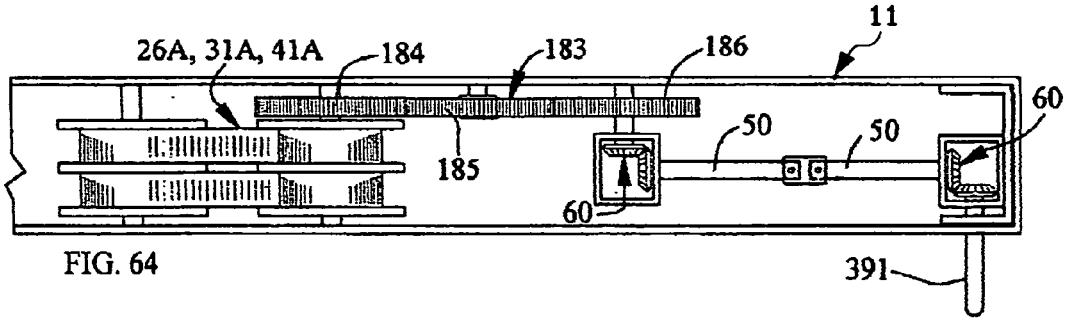
FIG. 64
FIG. 65
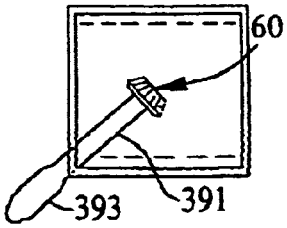

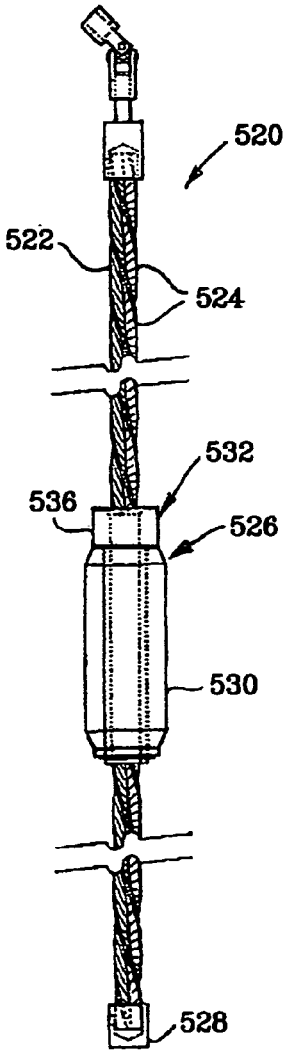
FIG. 71
FIG. 73
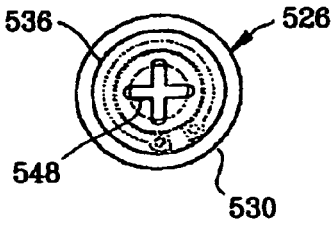
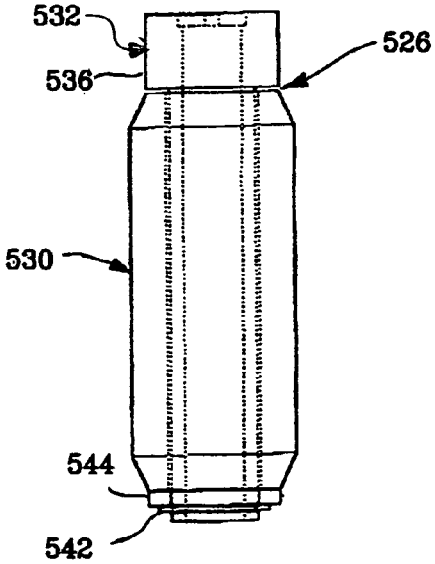
FIG. 72

FIG. 75
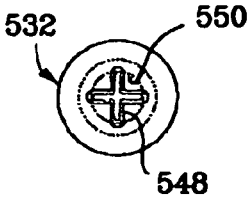
FIG. 77
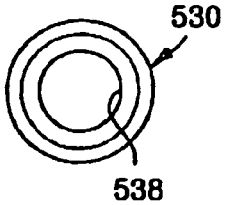
FIG. 79
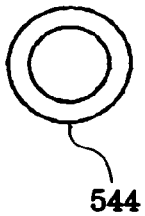
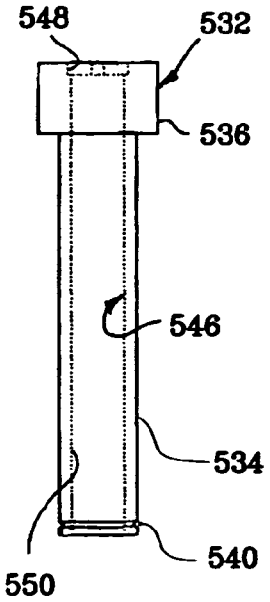
FIG. 74
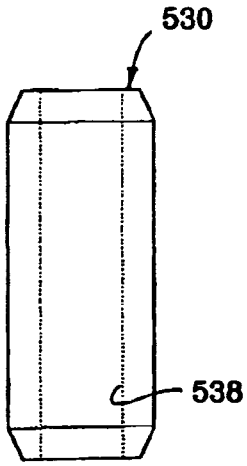
FIG 76
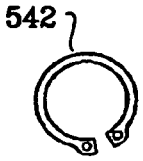
FIG. 78

FIG. 84
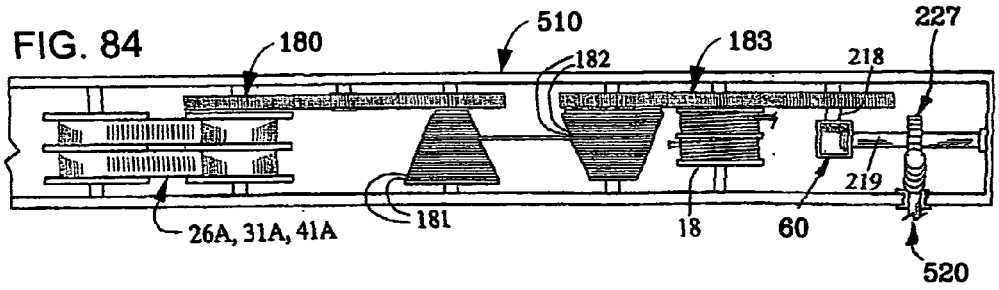
FIG. 85
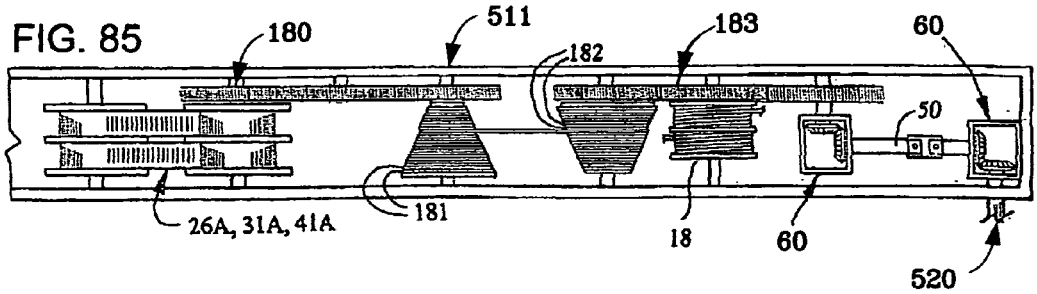
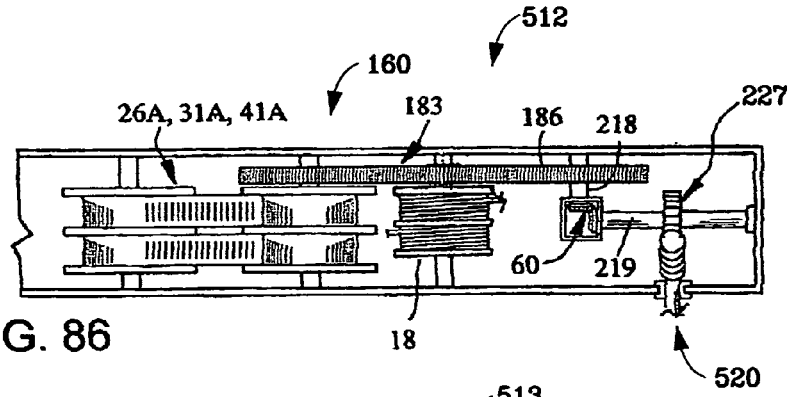
FIG. 86
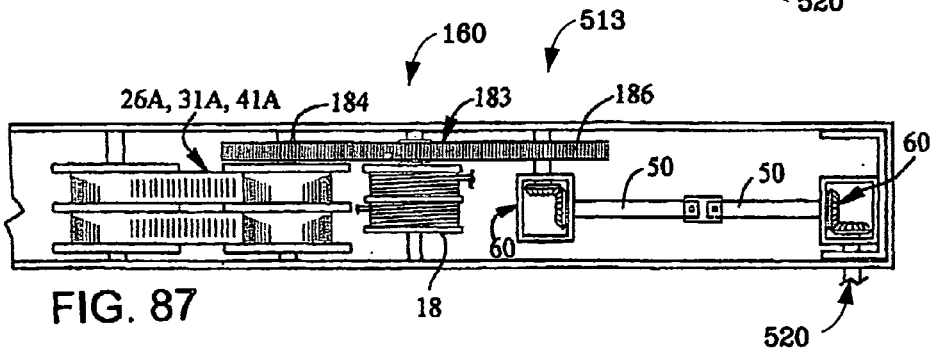
FIG. 87

CONTROL ROD MECHANISM AND SYSTEM

This application is a division of parent application Ser. No. 10/693,263, filed Oct. 23, 2003 now abandoned, titled Control Rod Mechanism and System. The parent application Ser. No. 10/693,263, is hereby incorporated by reference.

A. BACKGROUND OF THE INVENTION

1. Field of the Invention

The present invention relates to rotating control rods or wands for effecting and controlling the movement of loads such as covers, including but not limited to window covers.

2. Definitions and Applicability

Springs of the type shown for example in FIGS. 5C, 7C, 9C and 10C typically are referred to herein as coil springs. Springs of the type shown for example in FIGS. 6-8 typically are referred to herein as flat springs.

Typically, as used herein, the word "cover" refers to expandable or extendible structures such as blinds and drapes. These include slat structures such as so-called venetian or slat blinds and so-called mini-blinds. These structures also include pleated folding structures such as single and plural pleat structures and box, hollow and cellular structures. "Cover" also refers to flat, sheet-type covers such as roller blinds. In this document, "cover" and "blind" are frequently used interchangeably. As applied to such covers, "operate" refers to the process of closing and opening the covers, typically (for horizontally oriented or extending covers with the cover mounted and collected at the top) to lowering and raising the cover.

As used here, "horizontal" window cover refers to horizontally oriented covers such as horizontal slat blinds, horizontal folded-pleat blinds and drapes and horizontal cellular blinds and drapes. The present invention is applicable generally to horizontal window cover systems and to flat window cover systems. It is understood that "window," as used for example in "window cover," includes windows, doorways, openings in general and non-opening areas or regions to which covers are applied for decoration, display, etc.

As used here, the terms "operatively connected," "operatively coupled," "operatively connected or coupled" and the like include both direct connections of one component to another without intervening components and connections via intervening components including gears, transmissions, etc. Also, "plurality" means two or more.

3. Current State of the Relevant Technology a. Pull Cords

Typically, when used to control loads such as a cover or window cover, single pull cords can be used to pull the associated load in a single direction. Endless cords are used to pull the load in opposite directions.

Accordingly, in is one object of the present invention to provide a single pull cord mechanism which has the ability to pull loads such as covers and window covers in opposite directions, for example, to both extend and retract the load.

b. Slat and Resilient ((Pleated) Blinds

Typically a horizontal cover or blind is mounted above the window or space which is to be covered, and is operated using lift cords to extend the cover and lower it across the area, stopping at a selected position at which the blind partially or fully covers the area. For typical horizontal slat blinds, the lift cords are attached to a bottom rail and the "rungs" or cross-members of a separate cord ladder are positioned beneath the slats of the blind. When the blind is fully lowered, each slat is supported by a rung of the blind's cord ladder and relatively little weight is supported by the lift cords. However, as the blind is raised, the slats are "collected" on the bottom rail, and the support of the slats is thus increasingly transferred from the cord ladder to the bottom rail and the weight supported by the rail and the associated lift cords increases.

Many pleated, cellular, box, etc., blinds are formed of resilient material having inherent spring-like characteristics. As the resilient pleated blind is raised toward the fully open position, the blind material is increasingly compressed, and requires increasingly greater force to overcome the compression force and move the blind and hold the blind in position. Conversely, as the blind is extended and lowered toward a closed position, the compression of the pleats decreases. Effectively, then, both the slat blind and the pleated blind require increasingly greater force to open or raise the blind and to maintain the blind open than is required to close or lower the blind and maintain the blind closed.

c. Flat and Coil Spring Drives

The operating characteristics of conventional coil spring drives and conventional constant torque flat spring drives are not ideally suited to assist the opening and closing operation of horizontal and flat blinds, especially long or heavy blinds. As applied to downward-closing embodiments of such blinds, such spring drives usually are mounted at the top of the blind, and are operatively connected or coupled to the shaft about which the blind lift cords are wound. As described above, as the blind is lowered, the slat weight supported by the lift cords decreases and the compression of the pleats decreases.

However, in the case of the constant torque flat spring drive, as the blind is lowered (or raised) the torque force of the spring remains relatively constant as the supported slat weight or compression force of the lowering blind decreases, with the result that the spring torque may overcome the decreasing supported weight or the decreasing compression force, and raise the blind in fast, uncontrolled fashion. Also, it may be difficult to keep the blind at a selected position. Furthermore, if the blind is heavy, and requires a strong spring to maintain the blind open, the blind may be particularly susceptible to instability and uncontrolled raising operation when partially or fully extended (closed).

In the case of the coil spring drive, as the blind is lowered, the spring is wound and the energy stored in the coil spring increases, with the result that the increasing torque or force of the spring may then overcome the decreasing supported weight or the decreasing compression force and raise the blind in fast, uncontrolled fashion. Also, and as stated above regarding flat spring-assisted blinds, it may be difficult to keep coil spring-assisted blinds at a selected position and, if the blind is heavy and requires a strong spring to maintain the blind open, the blind may be particularly susceptible to instability and uncontrolled raising operation when partially or fully extended (closed). Conversely, when the coil spring-connected blind is at or near the upper limit of its travel (i.e., is open), the slat weight supported by the lift cords and the pleat compression are at or near maximum, while the coil spring torque is at or near minimum.

Frequently, prior art coil spring drives use latching mechanisms in an attempt to hold the blind or cover in position.

B. SUMMARY OF THE INVENTION

In one aspect, the present invention is embodied in a rotatable control rod mechanism, comprising: (a) a rod having a spiral thread configuration; (b) a spiral thread follower mounted on the rod for following the spiral thread configuration and thereby causing relative rotation between the rod and the spiral thread follower; (c) a handle mounted over the spiral thread follower for rotation about the spiral thread follower; and (d) a section of the spiral thread follower being exposed relative to the handle.

In another aspect, the present invention is embodied in a rotatable control rod mechanism, comprising: (a) a rotatable load; (b) a rod having a spiral thread configuration along the surface thereof; (c) means connecting the rod to the load for rotating the load and rod together; (d) a spiral thread follower having a collar, the follower mounted on the rod for rotating along the rod following the spiral thread configuration; and (e) a handle mounted over the spiral thread follower and exposing the collar thereof, the handle being adapted for rotating about the spiral thread follower. Engaging the collar to prevent rotation of the spiral thread follower and translating the spiral thread follower along the rod in a first or a second, opposite direction of translation moves the rod in, respectively, a first or a second, opposite direction of rotation. Engaging the handle to prevent rotation thereof while permitting rotation of the collar and the spiral thread follower around the rod and translating the handle along the rod in the first or second direction of translation moves the handle and spiral thread follower along the rod in, respectively, the first or second direction of translation.

In yet another aspect, the present invention is embodied in a plural stroke control rod mechanism, comprising (a) a rotatable shaft; (b) a rod having spiral convolutions; (c) means connecting the rod to the shaft for rotating the shaft and rod together; and (d) a handle device.

The handle device itself comprises a stepped cylinder comprising a first upper section or collar and a second lower section or tube having a bottom end. The outer diameter of the collar is of large dimension relative to the outer diameter of the tube. Further, the stepped cylinder has a longitudinal axis and has an internal axially-extending bore mounting the stepped cylinder along the rod for rotation along the spiral convolutions of the rod. The handle device further comprises a member having upper and lower ends, a longitudinal axis and an axial bore therein extending to the upper and lower ends thereof, the member rotatably mounting the tube of the stepped cylinder therein with the relatively large diameter collar of the stepped cylinder protruding from and rotatably seated along the upper end of the member. The stepped cylinder is of sufficient length such that the bottom end thereof protrudes from the bottom end of the bore of the member. The handle device further comprises means securing the lower end of the stepped cylinder to the member such that the stepped cylinder is rotatably captured to the member between the collar member and the securing means.

In operation, this construction functions such that engaging the collar to prevent rotation thereof while moving the handle device along the rod in a first or a second, opposite direction of translation rotates the rod and the connected shaft in a first or a second, opposite direction of rotation, respectively. Also, moving the handle device along the rod in the first or second direction of translation without engaging the collar to prevent movement of the collar shifts the position of the handle device in the first or second direction of rotation, respectively, without rotating the rod or the shaft.

In another aspect, the present invention is embodied in a method for reversibly and repeatedly rotating a rod having a spiral thread configuration, a thread follower mounted on the rod and a handle rotatably mounted over the spiral thread follower exposing a section of the spiral thread follower, the method comprising the step of engaging the exposed section to prevent rotation of the section and the spiral thread follower while translating the spiral thread follower along the rod in a first direction of translation or a second direction of translation and thereby rotating the rod in a first or a second direction of rotation, respectively; and, the step of engaging the handle to prevent rotation thereof while allowing rotation of the section and the spiral thread follower around the rod and translating the handle and the spiral thread follower along the rod in the first or second second direction of translation, thereby positioning the handle and the spiral thread follower for another first step.

In another method aspect, the present invention is embodied in a method for reversibly and repeatedly rotating a rotatable load, comprising: (a) connecting to the load a rod having spiral convolutions; (b) mounting on the rod a spiral thread follower having a collar and a handle rotatably mounted along the spiral thread follower exposing the collar; (c) selectively engaging the collar to prevent rotation thereof while sliding the handle along the rod in a first direction of translation or a second direction of translation, thereby rotating the rod in a first direction of rotation or a second direction of rotation; and (d) selectively sliding the handle along the rod in the first or the second direction of translation without engaging the collar sufficiently to prevent rotation thereof, thereby repositioning the handle along the rod along the first or second direction of translation without rotating the rod.

Other aspects and embodiments of the present invention are described in the specification, drawings and claims. These embodiments include application of the control rod or wand mechanism according to the present invention to covers and other loads, to effect and control reversible movement of the associated loads.

C. BRIEF DESCRIPTION OF THE DRAWINGS

The above and other aspects of the invention are described below in conjunction with the following drawings.

FIG. 8C is a side elevation view of a band or cord transmission in accordance with the present invention.

FIG. 11 is a perspective view of the varied cove spring of FIG. 7.

FIG. 12 is a perspective view of the perforated spring of FIG. 8.

FIGS. 13-19 and FIGS. 5C, 7C, 9C and 10C, etc. are top plan views of spring drive units embodying the present invention.

Figure 10C:
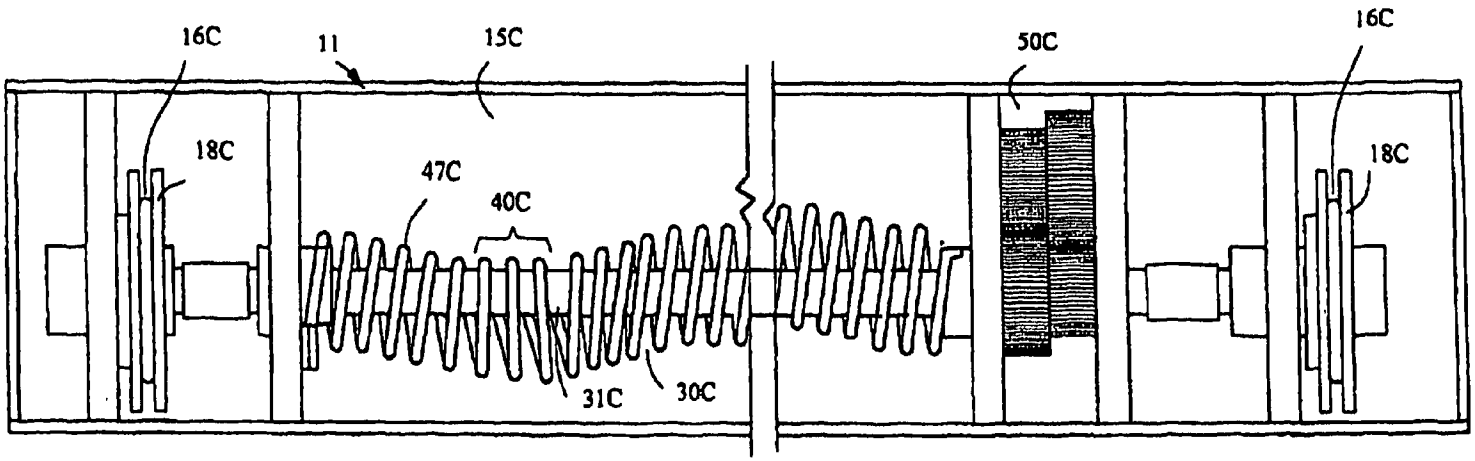
FIG. 10 is a perspective view of the flat spring of FIG. 6.
Figure 18:
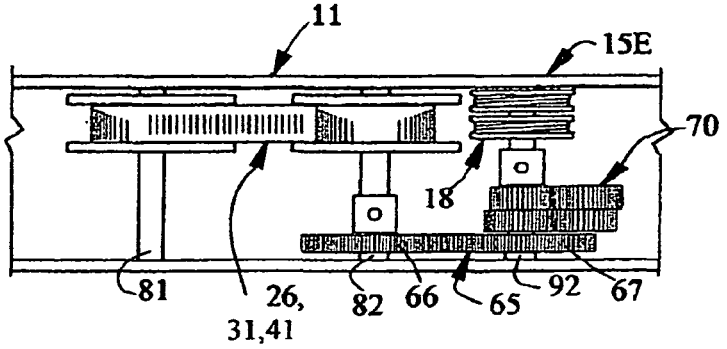
Figure 19:
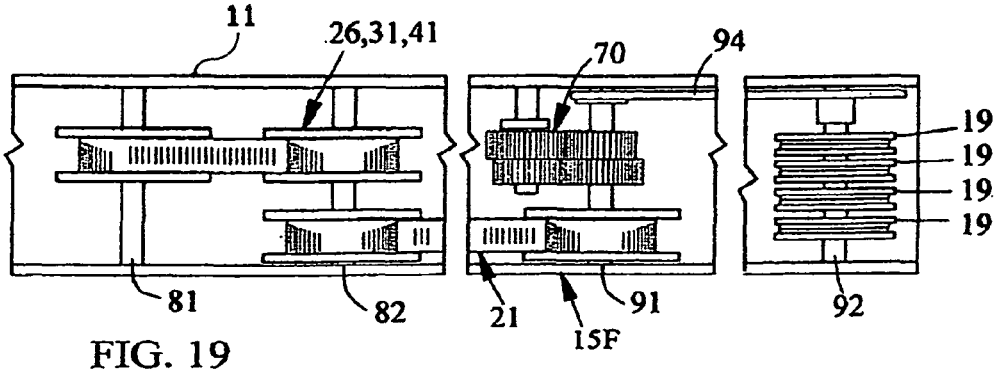

In particular, FIGS. 13, 18 and 19 are simplified top plan views of a flat spring drive unit in accordance with the present invention comprising a flat spring drive and a gear transmission, interconnected by a gear set and adapted for use in window cover systems such as those depicted in FIGS. 1-4. FIG. 5C is a simplified top plan view of a coil spring drive unit in accordance with the present invention, comprising a coil spring drive and a gear transmission, adapted for use in window cover systems such as those depicted in FIGS. 1-4. FIG. 10C is a simplified top plan view of the coil spring drive unit depicted in FIG. 5C, and showing the binding of the spring coils on the shaft when the spring is relatively fully wound and the associated cover is extended at or near the closed condition.

Figure 6:
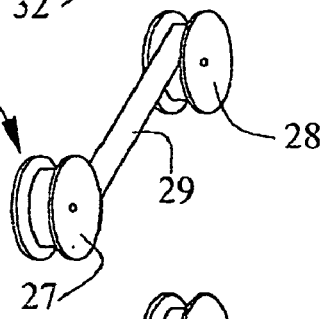
FIG. 6 is a perspective view of a flat spring drive.
Figure 6C:
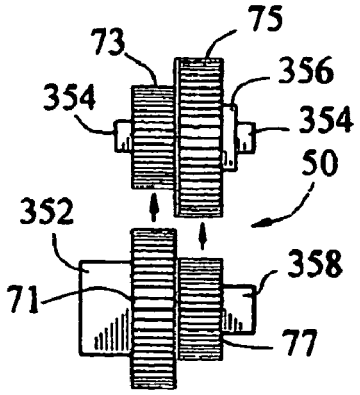

FIG. 6C is an exploded view of the gear transmission of FIGS. 5C, 13, etc.

FIGS. 14-17 are simplified top plan views of flat spring drive units in accordance with the present invention comprising a flat spring drive and an interconnecting gear means and adapted for use in window cover systems such as those depicted in FIGS. 1-4.

Figure 17:
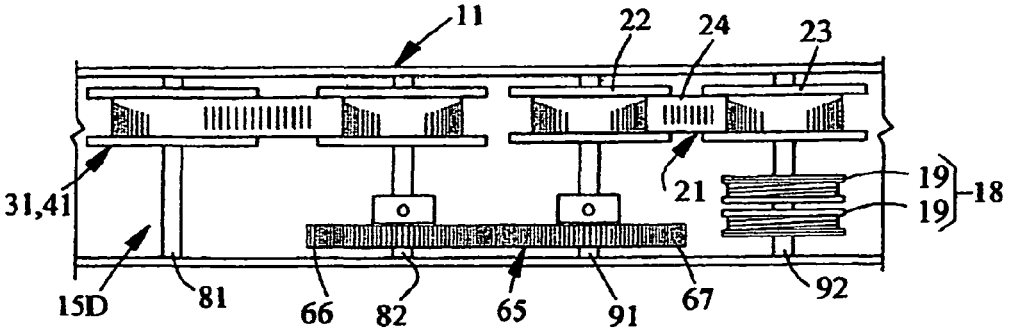

FIG. 17 is a simplified top plan view of a flat spring drive unit in accordance with the present invention comprising a flat spring drive and a band shift transmission, interconnected by a gear set and adapted for use in window cover systems such as those depicted in FIGS. 1-4. FIG. 7C is a simplified top plan view of a coil spring drive unit in accordance with the present invention, comprising a coil spring drive and a band shift transmission, interconnected by a gear set(s) and adapted for use in window cover systems such as those depicted in FIGS. 1-4.

Figure 9C:
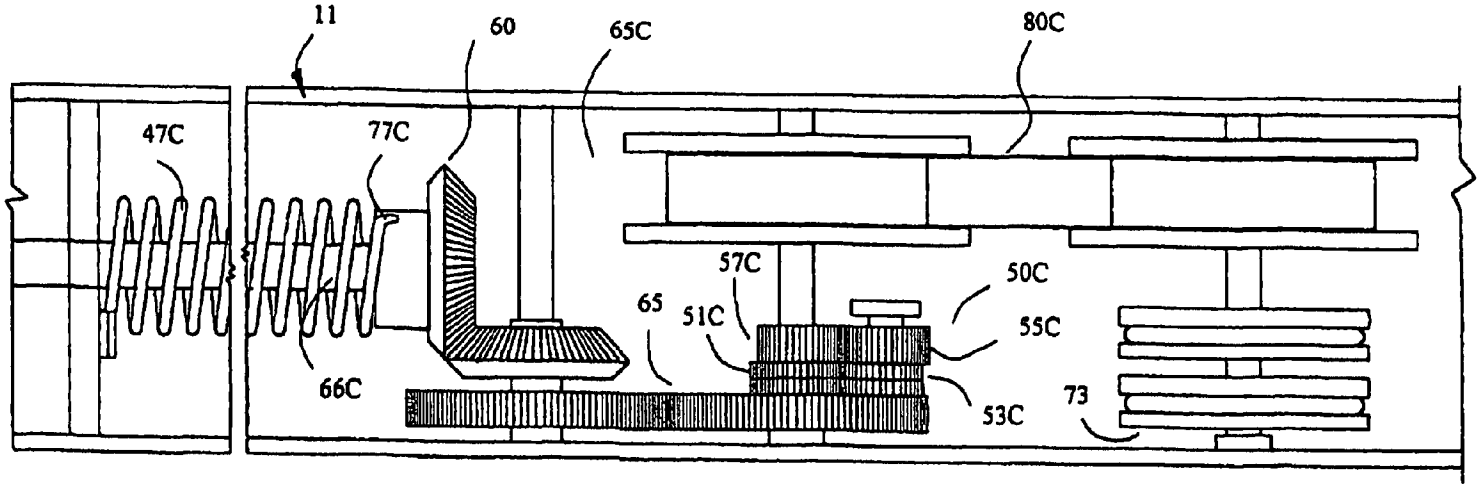
FIG. 9 is a perspective view of the band of FIG. 5.

FIG. 19 is a simplified top plan view of a flat spring drive unit in accordance with the present invention comprising a flat spring drive, a gear transmission, and a band shift transmission, and adapted for use in window cover systems such as those depicted in FIGS. 1-4. FIG. 9C is a simplified top plan view of a coil spring drive unit in accordance with the present invention, comprising a coil spring drive, a gear transmission and a band shift transmission, interconnected by a gear set(s) and adapted for use in window cover systems such as those depicted in FIGS. 1-4.

Please note, the coil springs illustrated in the above drawing figures, FIGS. 5C, 7C, 9C and 10C, are simplified, with enlarged spacing between the coils, to better illustrate the shaft and other components. For example, the individual coils of the actual spring of the type shown in FIGS. 5C and 10C are packed together, and in fact the increased packing of the wound spring is at least partially responsible for the binding illustrated in FIG. 10C.

FIGS. 14A and 14B depict the use of bevel gear sets to interconnect non-parallel components such as the pulley(s) and spring drives FIGS. 14C and 14D depict the wound/unwound condition of a spring drive when the associated cover or blind is in the raised and lowered position, respectively.

Figure 15A:
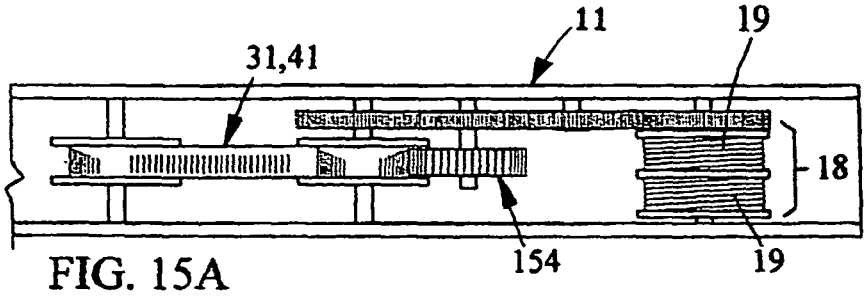
Figure 15:
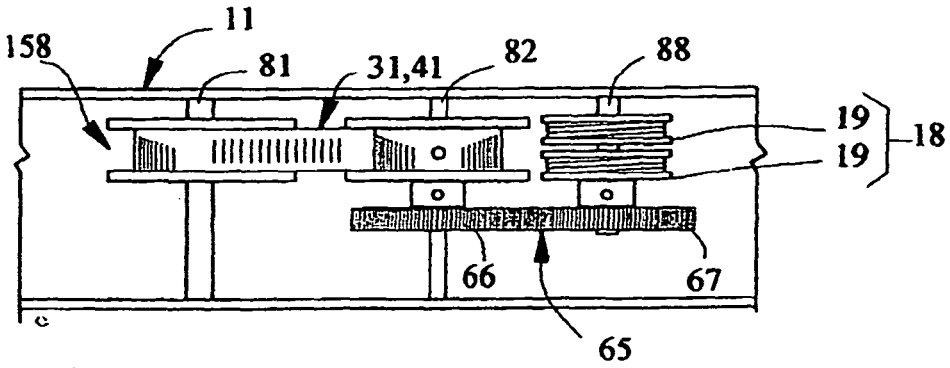

FIG. 15A depicts a spring drive unit which is similar to unit the unit depicted in FIG. 15, and includes a recoil roll.

FIGS. 20-28 and 42 depict additional embodiments of the perforated spring of FIG. 12.

FIGS. 29 and 30 are top and side views, respectively, of a perforated spring comprising separate sections joining by various joining means or members.

FIGS. 31 and 32 are top and side views, respectively, of a sectioned spring.

FIGS. 33-37 depict magnetic and detent brakes and components useful in spring drives.

Figure 33A:
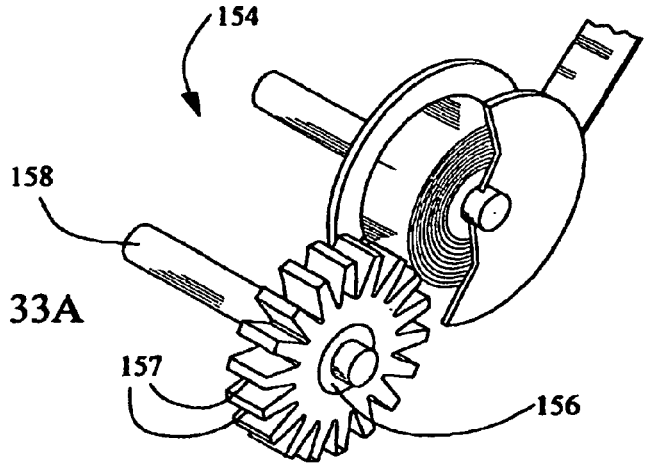

FIG. 33A depicts a braking device embodied in a recoiler roll which is useful with a spring drive unit as shown, for example, in FIGS. 15A and 39A.

Figure 33B:
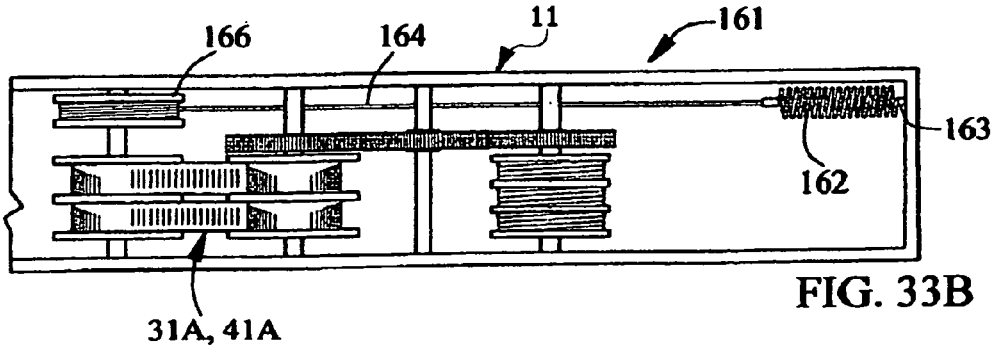

FIG. 33B depicts yet another braking device, one embodied in a coil spring recoiler.

FIG. 38 depicts a single spring drive unit which includes three lift cords and pulleys.

FIG. 39 depicts a window cover which includes a pair of drive units, each of which is similar to that of FIG. 38, but includes two pulleys and associated lift cords.

FIG. 40 depicts a window cover comprising a pair of spring drive units similar to those of FIG. 39 without the power transfer bar and with only one pulley in each drive unit.

FIG. 40A depicts a window cover drive system comprising multiple spring drive units in which each spring drive unit comprises a pair of springs mounted in parallel.

FIG. 41 depicts a simplified front elevation view of the system of FIG. 40, showing representative examples of the lift cord paths for two and four cord systems.

FIG. 42 depicts another alternative perforated spring, one which comprises two laterally spaced parallel rows of longitudinally spaced, longitudinally elongated slots 42, for providing uniform torque characteristics.

FIG. 42A depicts yet another perforated spring, one comprising longitudinally-overlapping elongated slots having round, semi-circular ends 42B, for providing uniform torque characteristics.

FIG. 43 is a perspective view of a varied torque, torque-multiplying, plural flat spring drive in accordance with the present invention.

FIG. 44 is a simplified front elevation depiction of FIG. 43 illustrating the relationship of the two spring drives and their overlapping springs.

Figure 45:
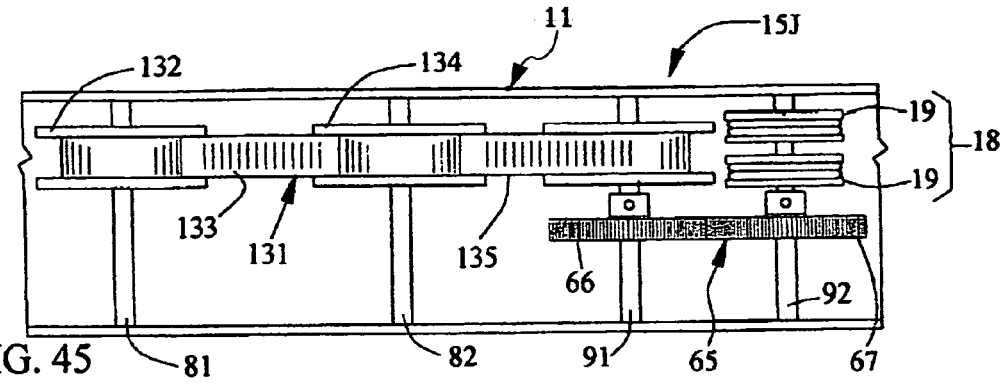

FIG. 45 is a top plan view of a spring drive unit embodying the plural spring drives of FIG. 43.

Figure 46:
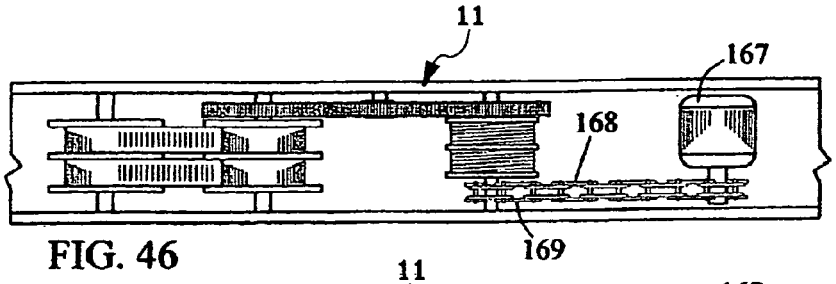
Figure 47:
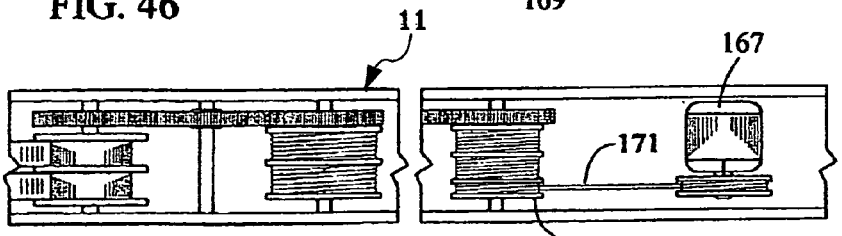
Figure 48:
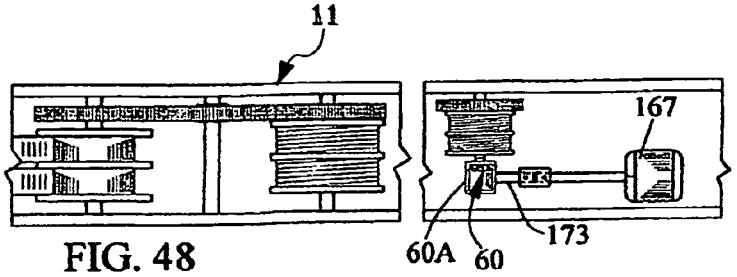

FIGS. 46-48 are top plan view of various embodiments of electric motor-assisted spring drive systems.

FIGS. 49 and 50 are, respectively, a front perspective view, partially broken away, and a top plan view of a simple compact embodiment of the plural-drive high torque spring drive system.

FIG. 51 is a perspective view of a direct or varied ratio cord pulley (band or cord shift transmission) system.

FIG. 52 is a top plan view of a section of a simple high torque spring drive system similar to the type of system shown in FIGS. 49 and 50, which includes the varied ratio cord pulley of FIG. 51.

Figure 53:
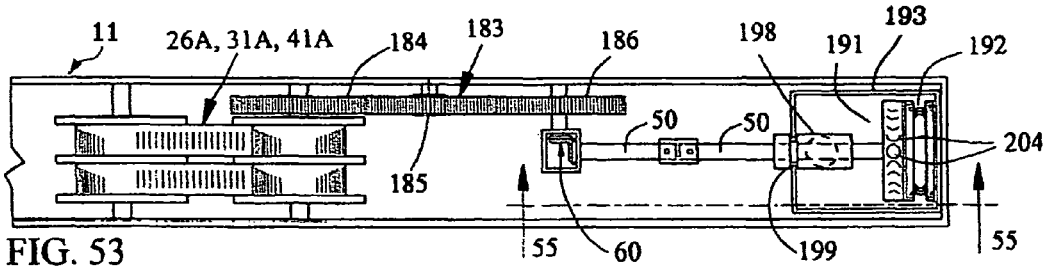
Figure 54:
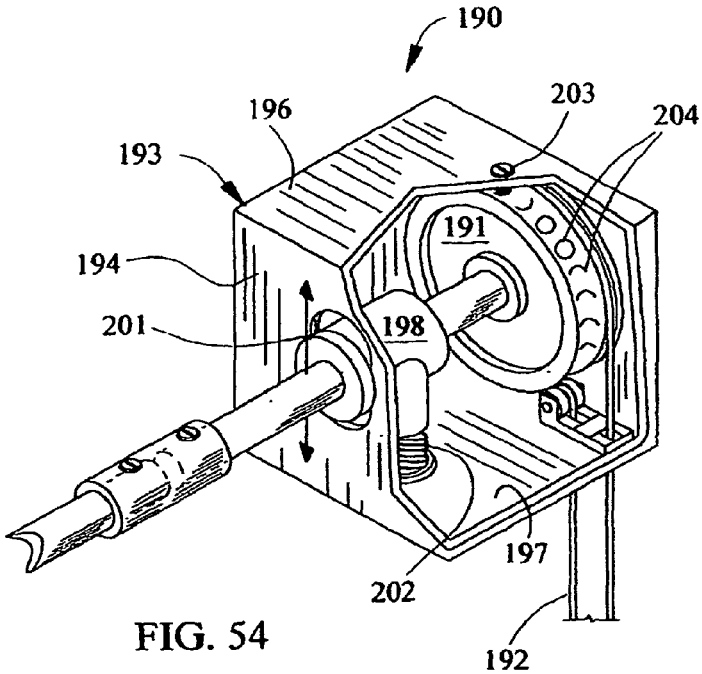

FIG. 53 is a top plan view of a section of a simple high torque spring drive system which includes the automatic cord locking mechanism of FIG. 54.

FIG. 54 is a front perspective view, partially cut away, of an automatic cord locking mechanism in accordance with the present invention.

Figure 55:
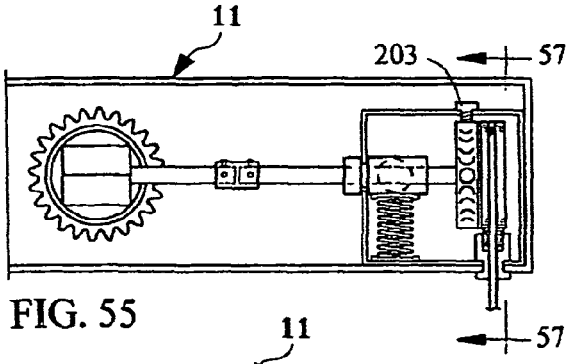
Figure 56:
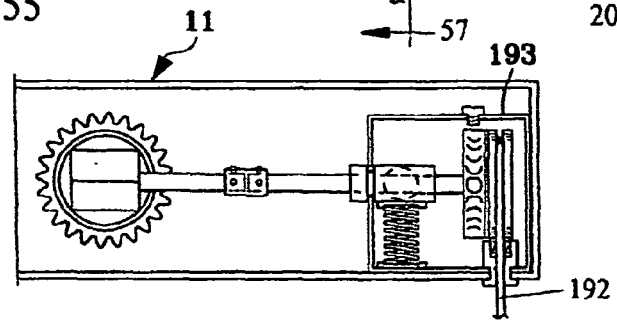

FIGS. 55 and 56 are partial front elevation section views taken along lines 55-55 and 56-56 in FIG. 53 and respectively showing the locking mechanism in the locked position and unlocked position.

Figure 57:
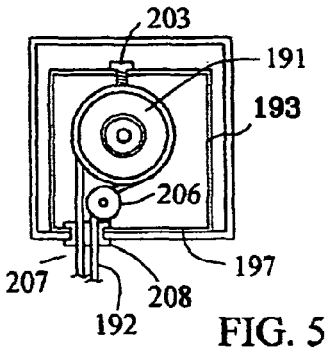

FIG. 57 is an end elevation section view taken along line 57-57 in FIG. 53.

Figure 58:
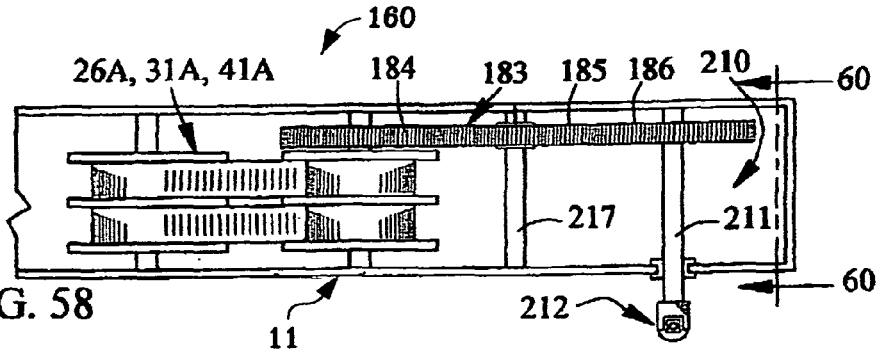

FIG. 58 is a top plan view of a section of a simple, crank-operated, multiple spring, high torque spring drive system in accordance with the present invention.

Figure 59:
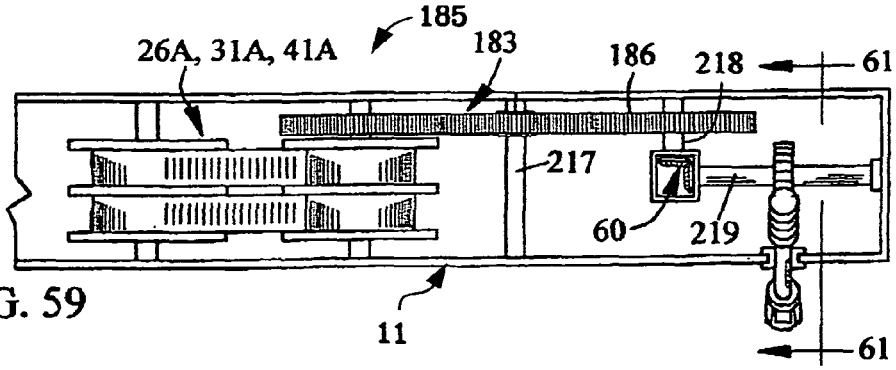

FIG. 59 is an end elevation section view taken along line 59-59 in FIG. 58.

FIG. 60 is a top plan view of a section of an alternative simple, crank-operated, multiple spring, high torque spring drive system in accordance with the present invention.

FIG. 61 is an end elevation section view taken along line 61-61 in FIG. 59.

FIGS. 62 and 63 depict a crank which is suitable for use in the systems disclosed in FIGS. 58-61.

FIG. 64 is a top plan view of a section of an alternative simple, crank-operated spring drive system in accordance with the present invention.

FIG. 65 is an end elevation view of the system of FIG. 64.

Figure 66:
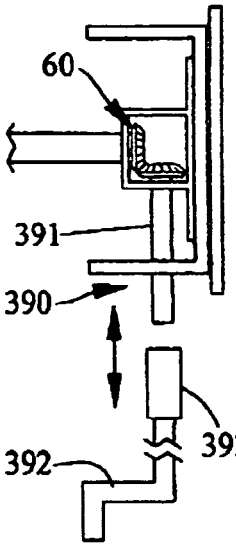

FIG. 66 is a front elevation view of the end section depicted in FIG. 65.

Figure 67:
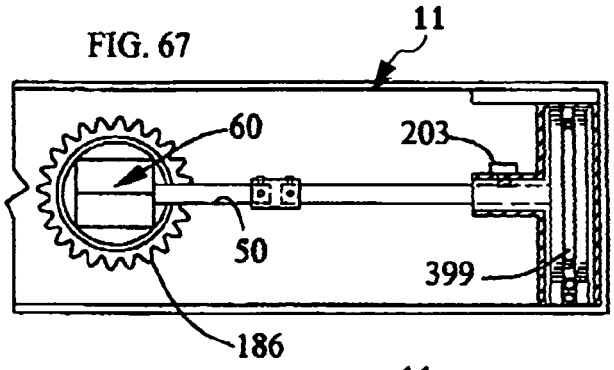
Figure 68:
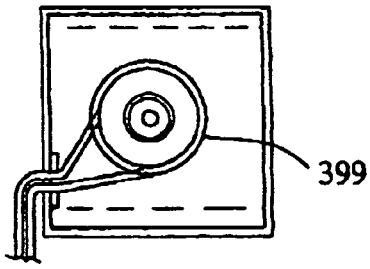

FIGS. 67 and 68 are, respectively, a front elevation view and an end elevation view of a front-emergent pull cord and pulley.

Figure 69:
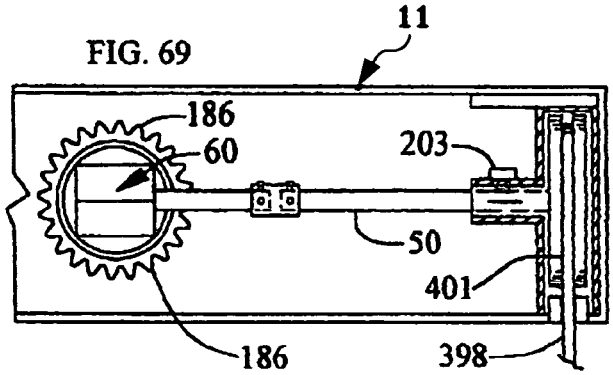
Figure 70:
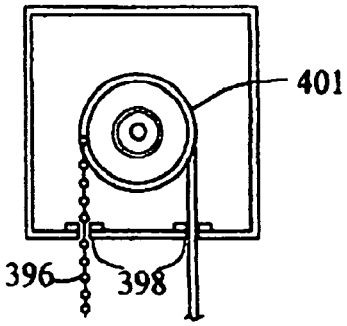

FIGS. 69 and 70 are, respectively, a front elevation view and an end elevation view of a bottom-emergent pull cord and pulley.

FIG. 71 is a side elevation view of an embodiment of a plural stroke, reversible control rod or wand mechanism in accordance with the present invention.

FIG. 72 is an enlarged partial view of the mechanism of FIG. 71, in particular of the handle member depicted in FIG. 71.

FIG. 73 is a top plan view of the handle member of FIG. 72.

FIGS. 74 and 76 depict, respectively, the thread follower member and the handle, both of which are components of the handle member of FIG. 71.

FIGS. 75 and 77 are top plan views of the thread follower member of FIG. 74 and the handle of FIG. 76, respectively.

FIGS. 78 and 79, respectively, depict the split ring clamp and the washer used to retain the handle of FIG. 76 to the thread follower member of FIG. 74.

Figure 80:
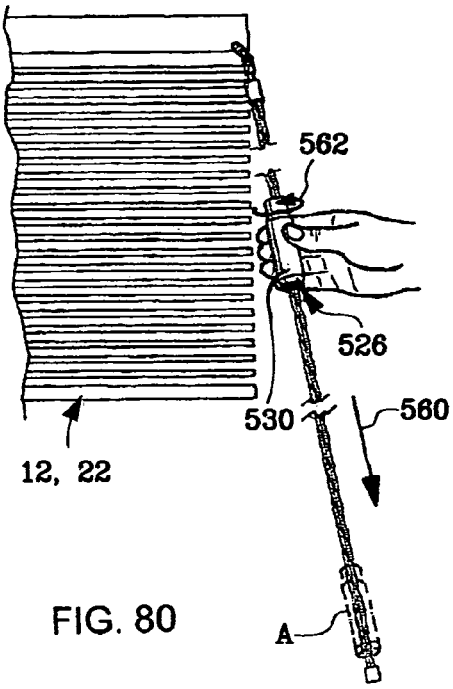
Figure 81:
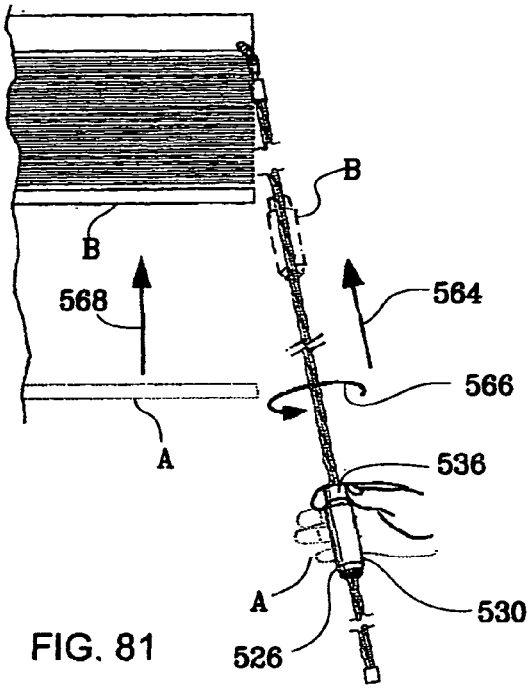

FIGS. 80 and 81 depict the operation of a cover system of the type shown for example in FIGS. 1-4, and in particular, the retraction of the associated cover using plural strokes of a reversible control rod or wand mechanism embodying the present invention.

Figure 82:
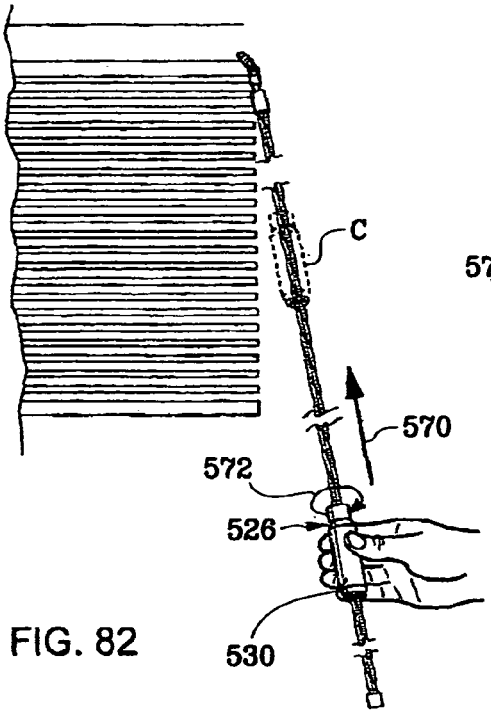
Figure 83:
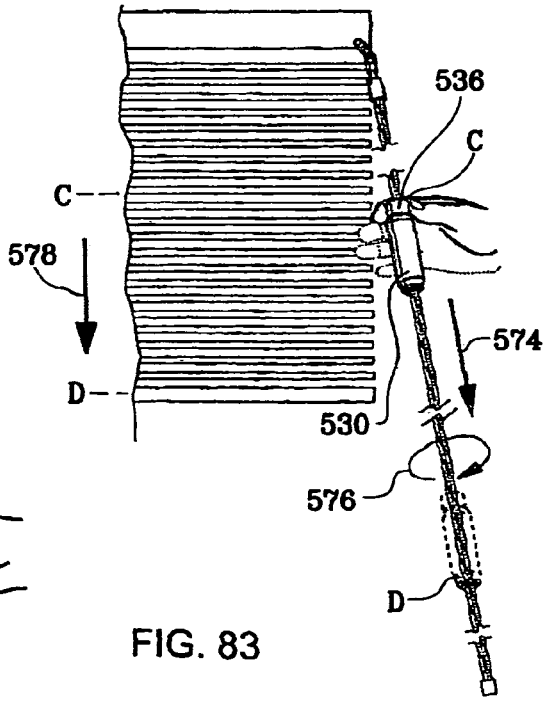

FIGS. 82 and 83 depict the operation of a cover system of the type shown for example in FIGS. 1-4, and in particular, the extension of the associated cover using plural strokes of a reversible control rod or wand mechanism embodying the present invention.

FIG. 84 is a top plan view of one embodiment of a plural stroke, rod- or wand-controlled cover system, in accordance with the present invention, which is an alternative embodiment of the spring-driven, band transmission-controlled cover system for example, of FIG. 52. The cover system of FIG. 84 includes a plural-stroke control rod mechanism of the type depicted in FIG. 71, and that mechanism is operatively connected to the cover system by a worm gear mechanism (and, in addition, and optionally, by one or more bevel gear sets).

FIG. 85 is a top plan view of another embodiment of a plural stroke, rod- or wand-controlled cover system, in accordance with the present invention, which is an alternative embodiment of the spring-driven, band transmission-controlled cover system, for example, of FIG. 52. The cover system of FIG. 85 includes a plural-stroke control rod mechanism of the type depicted in FIG. 71, and that mechanism is operatively connected to the cover system by one or more bevel gear sets.

FIG. 86 is a top plan view of yet another embodiment, in accordance with the present invention, of a plural stroke, rod- or wand-controlled cover system which is an embodiment of the cover system depicted, for example, in FIG. 59. The cover system of FIG. 86 includes one or more spring drives and a plural stroke control rod mechanism, which is operatively connected to the cover system by a worm gear (and, in addition, and optionally, by one or more bevel gear sets).

FIG. 87 is a top plan view of another embodiment, in accordance with the present invention, of a plural stroke, rod- or wand-controlled cover system which is an embodiment of the cover system depicted, for example, in FIG. 64. The cover system of FIG. 87 includes one or more spring drives and a plural stroke control rod mechanisms, which is operatively connected to the cover system by one or more bevel gear sets.

D. DETAILED DESCRIPTION OF THE PREFERRED EMBODIMENT(S)

1. Examples of Applicable Loads

Figure 1:
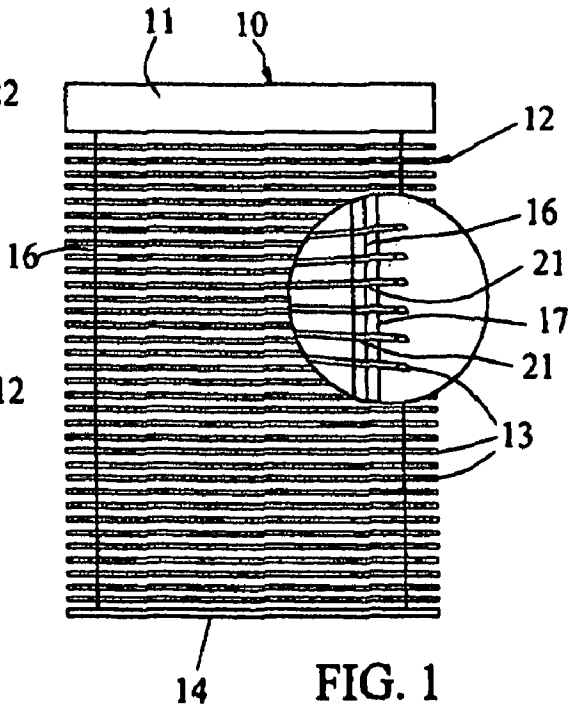
FIG. 1 is a front elevation view of a horizontal slat blind window cover system, showing the cover in a fully extended, fully lowered (closed) condition.
Figure 2:
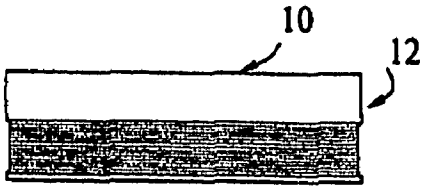
FIG. 2 is a front elevation view of the window cover system of FIG. 1, showing the cover in a nearly fully-retracted, nearly fully-raised (nearly open) condition.

FIGS. 1 and 2 depict a conventional horizontal slat (venetian) window cover system 10 in closed (fully lowered) and nearly fully open positions, respectively. The cover system 10 comprises an elongated top housing or support 11 within which a spring drive is mounted. The associated blind or cover 12 comprises horizontal slats 13 and a bottom rail 14 which can be the same as the slats but, preferably, is sufficiently heavy, or weighted to provide stability to the blind 12.

Figure 4:
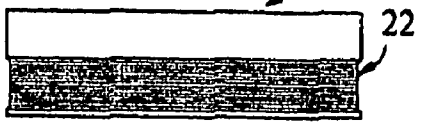
FIG. 4 is a front elevation view of the window cover system of FIG. 3, showing the cover in a nearly fully-retracted, nearly fully-raised (nearly open) condition.
Figure 3:
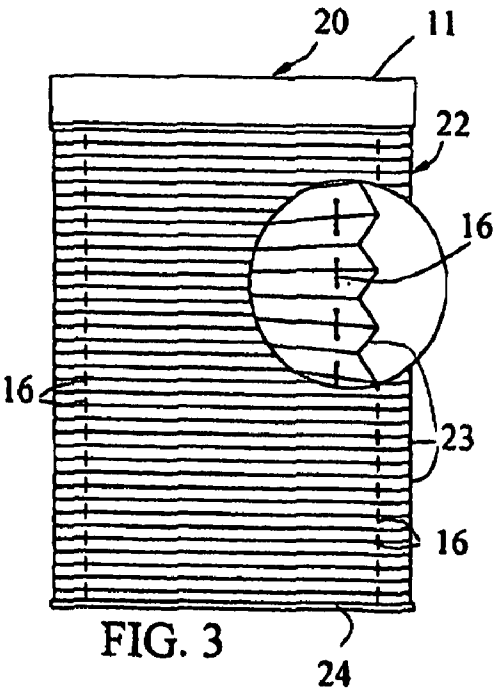
FIG. 3 is a front elevation view of a horizontal pleated blind window cover system, showing the cover in a fully extended, fully lowered (closed) condition.

FIGS. 3 and 4 depict a conventional horizontal pleated blind cover system 20 in closed and nearly fully open positions, respectively. The blind cover system 20 comprises housing 11 within which a spring drive unit is mounted. The associated blind or cover 22 typically comprises light weight fabric or other material which is resilient and maintains the shape of horizontal pleats 23. The blind also includes a bottom rail 24 which is sufficiently heavy or weighted, to provide stability to the blind 22.

Regarding slat blind 10, FIGS. 1 and 2, and as is typical of such blinds, spaced cord ladders 17 are suspended from the support 11 and the cross members or rungs 21 of the ladders are routed along and/or attached the underside of the individual slats 13 so that when the ladders are fully extended (lowered) and the blind 12 is thus fully lowered, as depicted in FIG. 1, the weight of each slat is supported by the ladders, with little weight on the lift cords. In contrast, as the blind 12 is raised from the lowermost position, for example to the partially raised/lowered position depicted in FIG. 2, the slats are sequentially "collected" on the bottom rail 14, starting with the bottommost slats, so that an increasing weight is supported on the bottom rail and by the lift cords 16. Thus, and perhaps counter-intuitively, the weight supported by the lift cords is a maximum when the blind is open (raised), and a minimum when the blind is closed (lowered).

As discussed previously, the force requirements of horizontal pleated blinds such as blind 20, FIGS. 3 and 4 are somewhat similar to the slat blind 10 in that the compression of the pleats 23 increasingly opposes compaction/compacting movement of the blind as it is raised, thus increasing the force required to open the blind and to maintain the blind in position. Conversely, the decreasing compression of the material as the blind expands as it is lowered toward the closed position decreases the force requirement.

The following exemplary spring drives and transmissions and other, interconnection components and devices are used in substantially any combination to provide easy-to-use, stable operation of various window coverings including but not limited to those of FIGS. 1-4.

Although the spring drives and transmissions according to the present invention are illustrated here by application to various window cover systems, more generally they are useful wherever spring drives of controlled torque are desirable. The wide applicability of the present invention is illustrated by several exemplary drive units, which include coil springs and flat springs of different cross section configurations, including numerous coved embodiments and numerous perforated embodiments. The drives are used alone, and/or in a combination comprising a plurality of the same drive and/or in combination with one or more of the other drives and/or in combination with one or more of the other components and devices described here. The wide applicability of the present invention is also illustrated by several transmissions of fixed and varying ratio, including gear transmissions and band/cord transmissions. The transmissions are used alone, and/or in a combination comprising a plurality of the same transmissions and/or in combination with one or more of the other transmissions and/or in combination with one or more of the other components and devices described here. The wide applicability of the present invention is further illustrated by several interconnecting devices and components, including bevel and other gear sets, which are used to selectively connect the drives and transmissions to one another and to other components in the associated application, for example, to the shafts and pulleys used in the exemplary window cover systems of FIGS. 1-4.

2. Spring Drives and Transmissions a. Band Shift Transmission

Figure 5:
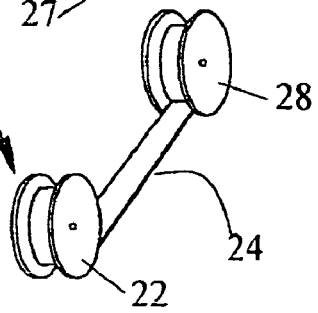
FIG. 5 is a perspective view of a band or cord shift transmission in accordance with the present invention.
Figure 5C:
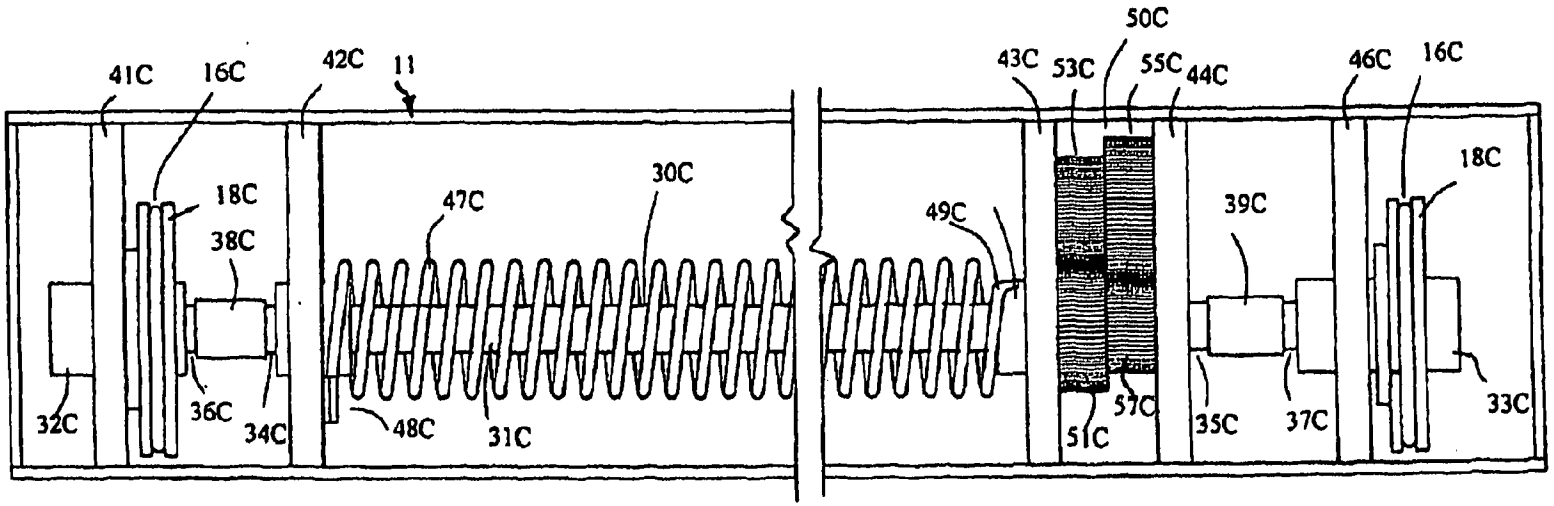

FIGS. 5, 9 and 51 depict direct or varied ratio cord or band shift transmission/cord pulley system/gear units such as 21 and 175. Unit 21 comprises a pair of drums or spools 22, 23, about which is wound a cord or band 24. Unit 175 comprises a pair of conical drums or spools 176-176 about which is wound a cord or band 178. The band 24 is an elongated strip of thin cloth or thin steel having a flat rectangular cross-section. However, other suitable materials can be used, and other cross-section shapes can be used which provide controlled variation in the radii on the drums. For example, an arcuate cross-section including a circular or oval cross-section cord-type band can be used, such as band or cord 178, FIG. 51. Thus, as used here, the term "band" includes, in accordance with the preferred embodiment, a thin, flat rectangular shape, but also includes other suitable cross-section shapes as well, including but not limited to the arcuate embodiment 178.

The cord or band shift transmission (also, simply "band transmission" or "shift transmission") provides a preferably varying drive ratio which is used to increase or diminish the torque or force of the spring drive unit. The band shift transmission applies the varying drive ratio between the spring drive and the lift cord pulleys. The ratio of the band transmission is determined by the radius of the band stored on each drum and the radius of the underlying drum. The radii vary as the band winds and unwinds, varying the associated gear ratio. Thus, increasing (decreasing) the thickness of the band, increases the rate at which the radii increase and decrease, and increases the gear ratio provided by the transmission. By way of example but not limitation, a band thickness of 0.014 inches has given satisfactory results.

The manner of mounting the band can be used to decrease or increase the ratio of the speed of the spring output drum relative to that of the lift cord pulleys as the blind is lowered. Preferably, the band 24 of transmission 21 is mounted so the band radius on output drum 23 increases relative to the band radius on storage drum 22 as the blind is lowered, and decreases as the blind is raised, thus offsetting or decreasing the power with which the spring would otherwise oppose the blind, enhancing or increasing somewhat the lifting power of the spring during raising of the blind, increasing the distance traveled by the blind relative to the spring drive, and increasing the maximum operational length of the blind (the distance between the fully raised and fully lowered positions).

The conical drums or spools 176, 176 of transmission 175, FIG. 51, are reverse oriented and the cord 178 moves longitudinally along the cones as the drums rotate, so that the output drum radius decreases relative to the storage drum radius as the blind is lowered and increases relative to the storage drum radius as the blind is raised, thereby increasing the force during lowering of the blind, decreasing the force during raising of the blind and decreasing blind length. Spiral grooves may be provided along the surface of the cones to control precise positioning of the cord at the desired radii of the cones.

b. Flat Spring Drives

Referring now to FIGS. 6 and 10, conventional "flat" spring drive unit 26 comprises a pair of drums or spools 27, 28, about which is wound a flat metal spring 29 that provides nearly constant torque regardless of its wound position on the drums.

Figure 7:
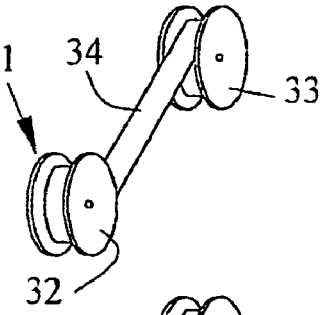
FIG. 7 is a perspective view of a varied torque, flat spring drive having varied cove in accordance with the present invention.
Figure 7C:
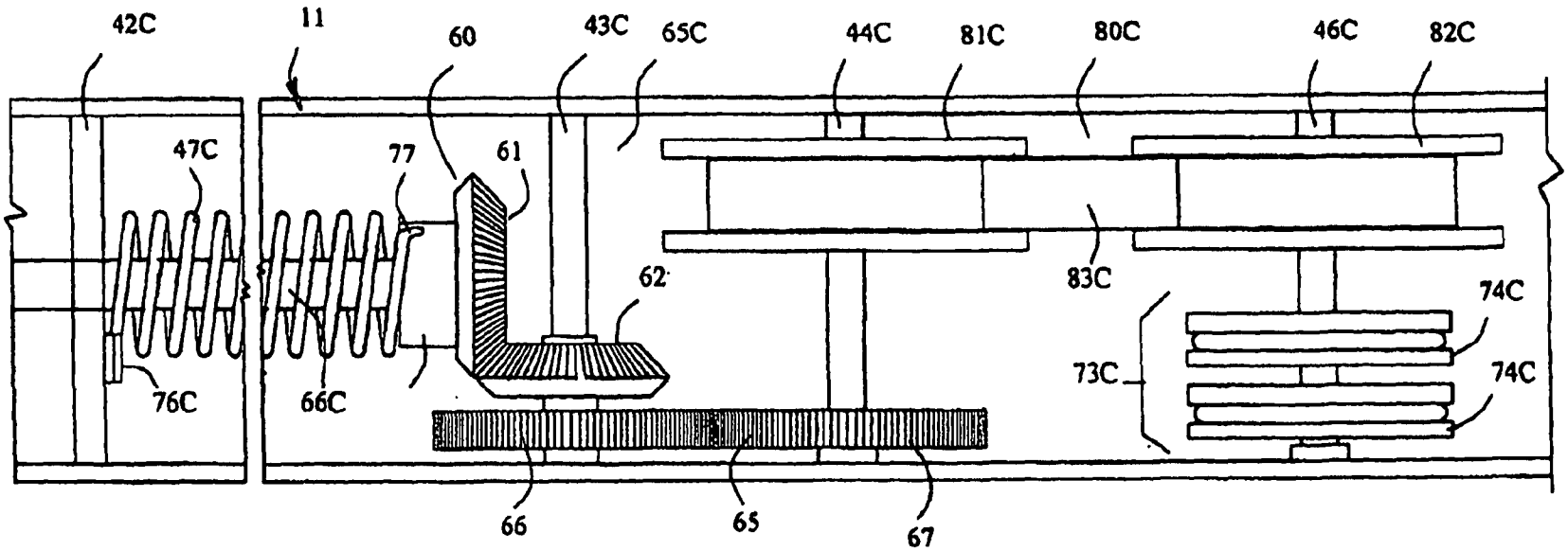

Referring next to FIGS. 7 and 11, varied torque flat spring drive unit 31 comprises a flat metal spring 34 of varying cove, which is wound around drums or spools 32, 33. One drum, such as left drum 32 is a storage drum; the other drum 33 is the output drum. The torque or force of the spring 34 is directly proportional to the degree of cove or transverse curvature of the spring. Thus, for example, and in one preferred embodiment, the cove varies from a relatively small degree of transverse curvature (nearly flat, small cove) at end 36 to a relatively large degree of curvature (large cove) at the opposite end 37. Examples, representative, but by no means limiting, are $\frac{3}{8}$ W×$\frac{1}{16}$ R of curvature or "coveness" at the shallow coved end and $\frac{3}{8}$ W×$\frac{3}{8}$ R of coveness at the highly coved end (W and R are, respectively, width and radius in inches.).

Figure 11A:
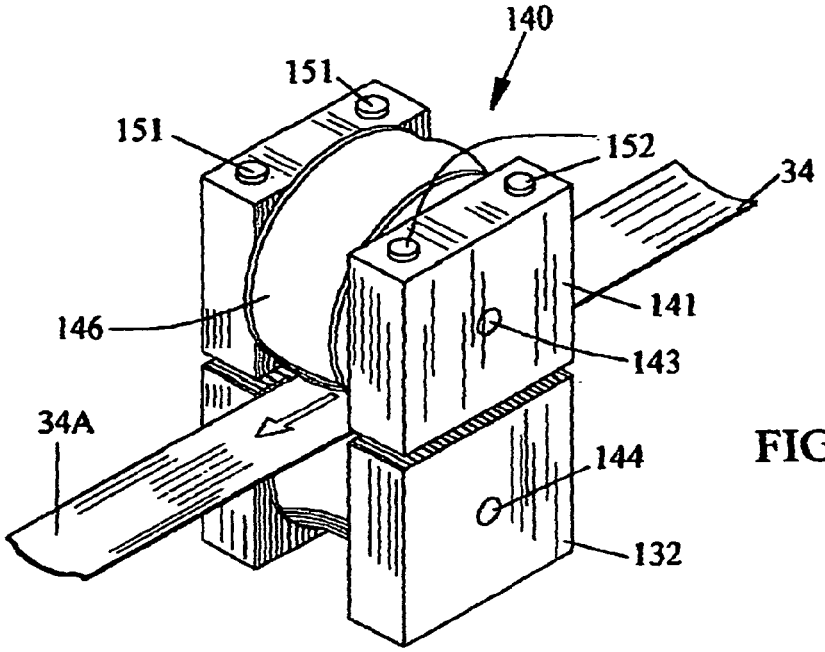
FIGS. 11A, 11B and 11C are, respectively, a perspective view, an end elevation view sans spring, and a schematicized side elevation view of a roll forming assembly for forming springs of constant or varied cove.
Figure 11B:
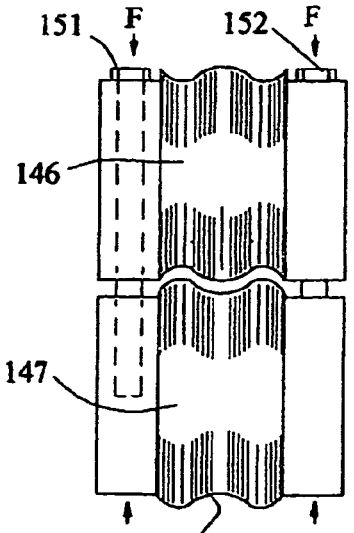
Figure 11D:
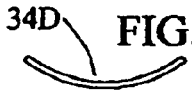
FIGS. 11D, 11E and 11F are transverse cross-section views of springs having, respectively, constant cove, relatively shallow reverse edge curvature, and relatively deep reverse edge curvature.
Figure 11E:
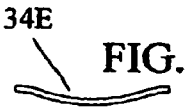
Figure 11F:
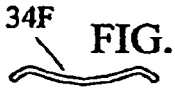
Figure 11C:
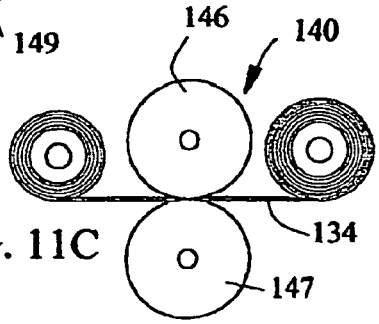

FIGS. 11A, 11B and 11C are, respectively, a perspective view, an end elevation view sans spring, and a schematicized side elevation view of a roll form assembly 140 for forming springs of constant or varied cove. As illustrated, the forming assembly 140 is used to form a non-coved or coved spring 34 into a spring 34A having a cove configuration having at least a section thereof which varies longitudinally, along the length of the spring, and/or transversely, along the width of the spring. In a preferred embodiment, at least a longitudinal section of the spring 34A comprises a reverse curvature or cove, FIGS. 11E and 11F, in which the configuration of one or both edges is different from the cove of the intermediate transverse region of the spring. That is, one or both edges (1) has a smaller curvature than the intermediate region, (2) is flat (no curvature), or (3) has a curvature opposite to that of the intermediate region, All three cases provide decreased torque, torque of smaller magnitude than would be available from a spring having the curvature of the intermediate region edge-to-edge. Specifically, a spring of configuration (1) or (2) provides lesser torque than is provided by a spring having the intermediate curvature edge-to-edge and, opposite curvature, configuration (3), actually provides a net spring torque which is less than the magnitude of the torque provided by the intermediate region.

Illustratively, the forming assembly 140 comprises upper and lower support block assemblies 141 and 142 which include shafts 143 and 144 mounting upper and lower rolls or wheels 146 and 147. The rolls 146 and 147 have oppositely configured, generally flattened "w" shaped, convex and concave surfaces 148 and 149, best depicted in FIG. 11B. The illustrated assemblies 141 and 142 are mounted on shafts 151 and 152 for movement relative to one another. Preferably, a computer-controlled drive system (not shown) moves the upper (and/or the lower) assembly and roll bidirectionally vertically relative to the other assembly to increase and decrease the force applied by the spring, thereby to control the configuration of the spring cove as the spring is passed through the forming assembly 140, as shown in FIG. 11A. The drive may be, for example, a screw drive which is connected to and moves the assemblies 141 and 142 and rolls in precisely controlled increments relative to one another. Many other drive arrangements are possible. For example, the shafts 151 and 152 may be screw drives which are mounted within threaded bores in the assemblies 141 and 142 and by rotation move the assemblies 141 and 142 relative to one another.

As alluded to above, a given spring 34 can have a constant cove or flat (non-coved) configuration along its length, can have a cove that varies continuously along its length, or can have sections selected from flat (non-coved), constant cove, and varied cove. The constant and varied cove sections can be selected from numerous configurations, including a single cove configuration 34D, FIG. 11D; and a double or reverse cove configuration 34E and 34F, FIGS. 11E and 11F. This allows the torque of the spring and of the resulting spring drive to be tailored to the supported weight of the associated blind at different positions between and including the fully closed and fully opened positions. For example, the coved spring configuration 34D may be used to provide a high (maximum value) torque for a given cove curvature for supporting a fully raised (open) blind; whereas configuration 34E, which has a similar central curvature but relatively shallow reverse-curved edge sections provides lower (intermediate value) torque than cove 34D, corresponding to a blind position intermediate the fully raised and lowered positions; and configuration 34F comprising similar central curvature but relatively deeply-curved edge sections effects even lower (minimum value) net torque, corresponding to the decreased supported weight at or near the lowered (closed) window cover position. Please note, typically the curvature in the drawings is exaggerated, to aid understanding.

Figure 8:
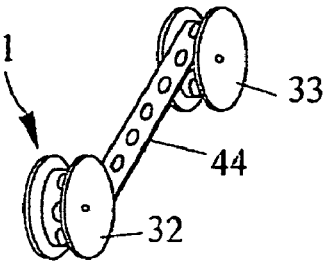
FIG. 8 is a perspective view of a varied torque, flat spring drive having holes in accordance with the present invention.

Referring next to FIGS. 8 and 12, varied torque flat spring drive 41 comprises a perforated spring 44 which is wound around wheels or spools 32, 33. Again drum 32 is the storage drum and drum 33 is the output drum. The torque or force of the spring 44 is directly proportional to the amount of spring material at a given point or region. The number, location, size and/or shape of the perforations or holes can be tailored to provide many different force curves, including constantly varying (decreasing or increasing), intermittent or discrete variations such as sawtooth or spiked force patterns, cyclical or sinusoidal patterns, etc. Thus, for example, and in one preferred embodiment, a line of spaced holes is formed generally along the center line of the spring 44, increasing in diameter from holes 47 of relatively small diameter near end 46 to relatively large diameter holes 48 near opposite end 49. As a result, the torque or force effected by the spring 44 decreases from a relatively large magnitude at end 46 to a relatively small magnitude at end 49, thereby decreasing the transverse cross section area and the associated torque of the spring. The hole size and spacing is selected to provide a drive force which varies in direct proportion to the lift cord-supported weight or the compression of the blind or cover 12, 22. That is, the force decreases as the spring is unwound toward the blind-fully-down position shown in FIGS. 1 and 3 and, conversely, increases as the spring is wound or rewound as shown in FIGS. 2 and 4 toward the blind-fully-up position. (This is in direct contrast to the operation of coil springs, whose spring force varies inversely to the variation of the cord-supported weight of the blind, and constant torque flat springs, whose force is approximately constant as the spring unwinds and winds.)

In general, the spring drive units 31 and 41 are configured so that contrary to the usual coil spring or flat spring operating characteristics, (1) as the spring unwinds or winds as the blind is lowered or raised, the spring torque or force decreases or increases in direct proportion to, and remains closely matched to, the supported weight or compressive force of the blind; (2) from a fully or partially open position, the blind is easily lowered to any selected position by a slight downward pull on the blind; (3) from a fully or partially closed position, a slight upward push by hand is sufficient to raise the blind to any selected position; and (4) the stability of the blind is enhanced in that the tendency of the blind to move from the selected positions is suppressed.

c. Coil Spring Drive 15 (FIGS. 5C and 10C)

Referring to FIGS. 5C and 10C, there is shown an exemplary embodiment 15 of a coil spring drive, and an application thereof to a window cover system. The illustrated spring drive unit 15 includes transverse frame members 341/41C, 342/42C, 343/43C, 344/44C and 346/46C. Cord pulleys 18C are mounted on the shaft 30/30C adjacent supports 341 and 346/46C. Spaced blind lift cords 16 are a shaft 30/30C comprising middle shaft or section 35/31C and left and right end shafts or sections 332/32C and 333/33C. Adjacent ends 334/34C, 336/36C of the middle and left shafts and adjacent ends 335/35C, 337/37C of the middle and right shafts have reduced radius or size and are joined by collars 338/38C and 339/39C. The separate shaft sections facilitate removal of the shaft 30/30C and installation and replacement of the drive components mounted on the shaft. The shaft 30/30C is rotatably journaled in and attached to bottom rail 14 (blind 10, FIG. 1), or to bottom rail 24 (blind 20, FIG. 3), or to other blinds/covers and are wound about the pulleys 18 for raising and lowering the attached bottom slat or rail and thus the blind 10 or 20.

d. Transmission 70 (Coil, FIGS. 5C. 10C; Flat, FIG. 13)

(1). Coil Spring Applications

Referring again to FIG. 5C, coil spring 40 is positioned between supports 342/42C and 343/43C, and is positioned around middle shaft section 331 (that is, the shaft 331/35/31C is inside the spring coils), for independent rotation around the shaft 30/30C. A first end of the coil spring 40 is attached by fastener 348/48C to support 342/42C so that the first end (illustratively, the left end) does not rotate. The opposite (right) end of the coil spring is attached by fastener 349/49C to gear sleeve 352/52C of transmission 70/50C. As described in detail below, that sleeve is connected to transmission idler gear 71/51C, so that the right end of the spring 40 rotates with the idler gear 71/51C of the transmission 70/50C and vice versa. The transmission 70/50C is designed to offset the normal operating characteristics of the coil spring 40. The stored energy of the spring increases as the spring is wound when the blind 10 or 20 is lowered and thus the increasing torque of the spring increasingly opposes lowering the blind. In short, the spring torque increases as the blind is lowered, while the lift cord-supported slat weight or the pleat compression is decreasing. Conversely, when the blind is raised, under the impetus or assistance of the spring, the stored spring energy and associated spring torque decrease, while the supported slat weight or the pleat compression of the raising blind is increasing.

Referring to FIGS. 5C and 6C, in one illustrated exemplary embodiment, the transmission 70/50C comprises an array of gears 71/51C, 73/53C, 75/55C and 77/57C, in which idler gears 71/51C and 73/53C are intermeshed and idler gear 75/55C and power gear 77/57C are intermeshed. Idler gear 71/51C and integral sleeve or collar 352/52C are mounted on and free to rotate about shaft section 335/35C. Gears 73/53C and 75/55C are joined, forming a gear set. This exemplary gear set and integral collar 356/56C are mounted on shaft 354/54C, which is mounted to and between supports 343/43C and 344/44C. The gear set and the collar rotate around shaft 354/54C and/or the shaft 354/54C itself is mounted for rotation. Power gear 77/57C and integral collar 358/58C are mounted on and fastened to shaft section 335/35C. Power gear 77 meshes with gear 75 of the two-gear set, the other gear 73 of which meshes with idler gear 71.

As mentioned, shaft end section 335/35C is part of the interconnected shafts (or shaft sections) 331/31C, 332/32C, 333/33C. Thus, at one end of the transmission gear train, power gear 77/57C is joined to and rotates at the same rate as the shaft 30/30C. At the opposite end of the transmission gear train, idler gear 71/51C rotates freely about the shaft 30/30C and is fastened to the free spring end by fastener 349/49C, so that the idler gear 71/51C and coil spring 40 rotate at the same rate. As the result of this arrangement, the pulleys 18 and lift cords 16 rotate at one rate, the same rate as gear 77/57C and shaft 30/30C, and the coil spring 40 rotates at another rate, the same rate as gear 71/51C. The transmission gear ratio is selected so that the idler gear 71/51C and coil spring 40 preferably rotate at a slower rate than the power gear 77/57C and the lift cord pulleys 18. For example in one application, the fixed drive ratio of transmission 70/50C is 1:3 to 1:8 so that gear 77/57C and pulleys 18 rotate 3-8 revolutions for each revolution of the gear 71/51C and coil spring 40.

The above transmission gear ratios and the different rotation rates diminish proportionately the wind up of the spring 40 and the rate at which the torque exerted by the spring 40 increases as it is wound and the blind is lowered. This permits the use of a powerful spring to hold a large, heavy blind in position at the uppermost position, where the supported weight (or the pleat compression force) is the greatest, and diminishes the inherent rate of increase of the torque exerted by the spring as the blind is moved toward the lowermost, closed condition where the supported weight (the pleat compression force) is a minimum. Also, and referring to FIG. 10C, as the spring 40 winds up, it buckles in serpentine fashion along the shaft 35/31C, and contacts the shaft at a multiplicity of locations 45/40C (only one such location 45/40 is shown), exerting pressure on the shaft and preventing the shaft from turning on its own, thereby providing braking action against shaft rotation. The braking helps keep the shaft and pull cord from moving when at rest but does not impede raising and lowering movement. Furthermore, the transmission 70/50C has inherent friction which acts as a brake and helps retain the blind at the selected position(s) between and including fully opened and fully closed.

As a result of the above factors, the spring does not overpower the weight of the blind and does not uncontrollably raise the blind. The transmission gear ratio also increases the length of travel available to the blind for a given spring, permitting a longer blind for a given spring or a given spring travel. The combination of the coil spring, transmission fixed gear ratio, gear friction and the spring buckling braking action allows the spring drive unit 15 to hold the blind 10, 20 in position at even the "heaviest" (uppermost) blind positions, prevents the spring from overpowering the blind, especially when the spring is wound (at the lower blind positions), and allows the blind to be pulled downward to any selected position by gently pulling the blind to that position and, conversely, to be pushed upward to any selected position by gently pushing upward to that position. Little force is required to move the blind up and down, the blind stops accurately at any selected position between and including the fully opened and fully closed positions, and the blind remains at the selected positions.

As an example of the improved operation resulting from the use of a spring drive 15, when a standard coil spring was used in a 3'×4' DUETTE hollow pleat blind, near the end of the 4' travel of the blind, the increasing spring torque became too great for stable operation and overpowered the weight of the blind, retracting the blind. The use of spring unit 15 comprising the same standard coil spring as before and the gear transmission, in a 4'×6' DUETTE hollow pleat blind provided smooth stable operation in which the blind stayed in position, even in the 6' fully extended, fully closed position. The 6' travel effected sufficient buckling to provide braking action which assisted in keeping the blind at rest. In contrast, the 4' travel of the smaller 3'×4' blind did not cause enough buckling to noticeably effect buckling braking.

(2). Flat Spring Applications

The spring drive unit such as 26, 31, 41 is operatively connected by bevel gear set 60 to shaft 50, FIG. 13, and transmission 70. The bevel gear sets permit compact arrangements for transferring power/rotation when interconnected components such as the pulley(s) and the spring drive(s) are mounted on shafts which are non-parallel. As described in detail below, the shaft 50 is connected to transmission idler gear 71, so that the right side, output drum rotates with the idler gear 71 of the transmission 70 and vice versa. The transmission 70 is designed to increase or reduce the torque of the spring drive unit, as desired.

In one illustrated exemplary embodiment, the transmission 70 comprises an array of gears 71, 73, 75 and 77, in which idler gears 71 and 73 are intermeshed and idler gear 75 and power gear 77 are intermeshed. Idler gear 71 and an integral sleeve or collar are mounted on and rotate with shaft section 53 and vice versa. Gears 73 and 75 are joined, forming a gear set. This gear set and an integral collar are mounted on and fastened to shaft 74, which is mounted to and between supports 84 and 86. Power gear 77 and an integral collar are mounted on and fastened to shaft section 53. Power gear 77 meshes with gear 75 of the two-gear set, the other gear 73 of which meshes with idler gear 71.

As mentioned, shaft end section 53 is part of the interconnected shafts (or shaft sections). Thus, at one end of the transmission gear train, power gear 77 is joined to and rotates at the same rate as the shaft 53 and lift cord pulleys 19-19. At the opposite end of the transmission gear train, idler gear 71 and interconnected bevel gear 62 rotate freely about the shaft 50 and are connected via bevel gear 61 to the right side drum 33 of the spring drive. As the result of this arrangement, the pulleys 19-19 and the lift cords 16, 17 rotate at one rate, the same rate as gear 77; and shaft 50, the right side output drum 33, the idler gear 71 and the bevel gears 60 rotate at a second rate.

Preferably the transmission gear ratio is selected so that the idler gear 71 and spring drive 26, 31, 41 rotate at a slower rate than the power gear 77, the pulleys 19-19, and the lift cords 16, 17. For example in one application, the fixed drive ratio of the transmission 70 is 1:3 to 1:8 so that gear 77 and lift cord pulleys 19-19 rotate 3-8 revolutions for each revolution of the right side output drum 33 of the spring drive. Obviously, however, in applications where such is advantageous, the drive ratio of the transmission can be selected to rotate the spring drive faster than the lift cord pulleys.

The above transmission gear ratios and the different rotation rates diminish proportionately the torque exerted by the spring 29, 34, 44 as it is wound in one direction and the blind is lowered. This permits the use of a powerful spring to hold a large, heavy blind in position at the uppermost position, where the supported weight and the pleat compression is the greatest, and diminishes the force otherwise exerted by the spring at the lowermost, closed condition where the supported weight and the pleat compression is a minimum. As a result, a powerful spring does not overpower the weight of the blind and does not uncontrollably raise the blind. The transmission gear ratio also increases the length of travel available to the blind for a given spring, permitting a longer blind for a given spring or a given spring travel. Furthermore, the transmission 70 has inherent friction which acts as a brake and retains the blind at selected positions between and including fully open and fully closed. The combination of the preferably varying torque/force provided by the flat spring drive directly proportional to the supported weight/compression of the blind; the transmission gear ratio; and the gear friction allows the spring drive unit to hold the blind 10, 20 in position at even the "heaviest" (uppermost) blind positions, and allows the blind to be pulled downward to any selected position by gently pulling the blind to that position and, conversely, to be pushed upward to any selected position by gently pushing upward to that position. Little force is required to move the blind up and down, the blind stops accurately at any selected position between and including the fully open and fully closed positions, and the blind remains at the selected positions.

3. Coil and Flat Spring Drive Window Covers a. Spring Drive and Transmission (FIG. 13)

Referring further to FIG. 13, there is shown spring drive unit 15 which embodies the present invention. The spring drive unit is mounted inside housing 11 and includes shaft 50 comprising left shaft or section 51 and right shaft or section 52. Adjacent ends 53, 54 of the shafts 51, 52 have reduced radius or size and are joined by collar 56. The separate shaft sections facilitate the removal of shaft 50 and the installation and replacement of the drive components mounted on the shaft. The shaft 50 is rotatably journaled within transverse walls or support members 57, 58. Two lift cord pulleys 19 and 19 are mounted on the shaft 50 adjacent the transverse walls 57 and 58. The spaced lift cords 16 and 17 are attached to bottom rail 14 (FIG. 1), 24 (FIG. 3) and are wound about the pulleys 19-19 for raising and lowering the bottom rail and thus the blind 10 or 20.

Referring further to FIG. 13, flat spring drive 26, 31 or 41 is mounted on transverse shafts 81, 82. The outer end of each shaft is mounted to the housing 11 and the opposite, inner end is mounted to longitudinal wall or support member 83. Of these spring drives, unit 26 is a conventional constant force or torque drive. However, spring drives 31 and 41 are unique variable force or torque units in accordance with the present invention, which preferably are specially adapted to provide a drive force which varies in direct proportion to the lift cord-supported blind weight or the pleat compressive force. That is, the spring force changes, preferably decreases, as the spring is unwound and the blind is extended toward the fully-down position and, conversely, increases as the spring is wound and the blind is retracted toward the fully-up position. (This is in direct contrast to the operation of coil springs, in which the spring force varies inversely to the variation of the cord-supported weight or compression of the blind.)

The output of the spring drive 26, 31, 41 is connected via power transfer bevel gear set 60 and transmission 70 to the cord pulleys 19-19. One gear 61 of bevel gear set 60 is mounted on drum mounting shaft 82 and meshes with the second gear 62, which is mounted on section 53 of shaft 50. The second bevel gear 62 is connected to the transmission 70, which is mounted on shaft section 53. The transmission varies the rate at which the cord pulleys 19 and 19 rotate relative to the rotating drum of the spring drive.

Illustratively, in one application, the transmission gear ratio is 3:1 to 8:1 so that lift cord pulleys 19-19 rotate 3-8 revolutions for each revolution of the rotating spring drive spool.

As alluded to, preferably, a varied force spring drive unit is used, one which exerts diminished force as the blind is lowered, and preferably one which tracks the decreasing supported weight or compression force of the blind 10, 20 as the blind is lowered. The above transmission gear ratios and the different pulley and spring rotation rates diminish proportionately the force exerted by the spring as it is wound and the blind is lowered. This permits the use of a more powerful spring to hold a large, heavy blind in position at the uppermost position, where the cord-supported weight is the greatest, and proportionately diminishes the force exerted by the spring at the lowermost, closed condition when the supported weight is a minimum, so that the powerful spring does not overpower the weight of the blind and does not uncontrollably raise the blind. The gear ratio also increases the length of travel available to the blind for a given spring, permitting a longer blind for a given spring or a given spring travel. (For example, for the described 3:1 ratio, the possible blind length is 3 times the maximum spring rotation.) Furthermore, the transmission 70 and the bevel gear set 60 have inherent friction which individually and collectively act as a brake and retain the blind at any selected position between and including fully open and fully closed. The combination of the preferably varied force spring drive, the transmission gear ratio and the gear friction allow the spring to hold the blind in position at even the "heaviest" (uppermost) blind positions, and allow the blind to be pulled downward to any selected position by gently pulling the blind to that position and, conversely, to be pushed upward to any selected position by gently pushing upward to that position. Little force is required to move the blind up and down, the blind stops accurately at any selected position between and including the fully open and fully closed positions, and the blind remains at the selected positions.

b. Spring Drive and Bevel Gears (FIG. 14)

FIG. 14 depicts a spring drive unit 15A which is essentially unit 15, FIG. 13 without the transmission 70. Also, the shaft 50 depicted in the figure is of one-piece construction. A constant or varied force spring drive 26, 31, 41 is mounted on the transverse shafts 81 and 82, with shaft 82 also mounting bevel gear 61. Mating bevel gear 62 is mounted on the shaft 50 and, as a result, the shaft 82 and associated rotating spring drum are connected by the bevel gear set 60 directly to shaft 50 and the lift cord pulleys 19-19, and rotate at the same rate as the pulleys. Although a constant force spring drive can be used, a varied force drive is much preferred, to tailor the spring force to the blind weight or compression, as described above relative to FIG. 13. In addition, the bevel gear set 60 provides friction which assists the constant or the varied force spring drive in maintaining the blind at the selected positions. The bevel gear set 60 can be a 1:1 direct drive or a non-direct drive.

FIGS. 14A and 14B depict other applications of bevel gear sets 60 for transferring power/rotation when interconnected window lift components such as the pulley(s) and spring drive(s) are mounted on shafts which are non-parallel. FIG. 14A illustrates a spring drive such as 31 or 41 positioned intermediate spaced-apart end pulleys 19-19. The shafts at the opposite ends of the gear train are oriented 90° to the associated pulley shafts and are connected at each end to the associated pulley shaft by a bevel gear set 60 located in housing 60A. Illustratively, the pulley shafts comprise sections which are interconnected by removable connectors 153, thereby facilitating removal of the pulley(s) or the spring drive unit(s) without removing the other components.

FIG. 14B illustrates a spring drive such as 31A or 41A located on one side or end of the associated blind, and two spaced pulleys 19-19 mounted on the opposite side or end. The gear train shaft is oriented 90° to the associated pulley shaft and is connected to that pulley shaft by bevel gear set 60. The illustrated spring drive 31A, 41A comprises a pair of springs mounted in parallel on integral or joined storage spools and output spools, thereby providing increased torque.

FIG. 14C depicts the spring of drive 31A, 41A substantially fully wound on the storage (left) spool when the associated blind is at its topmost, fully raised (open) position, whereas FIG. 14D depicts the spring substantially fully wound on the output (right) spool when the associated blind is fully lowered (closed).

c. Spring Drive and Transfer Gears (FIG. 15)

FIG. 15 depicts a spring drive unit 15B which is yet another alternative to the drive unit 15, FIG. 13. A constant or a varied force spring drive 26, 31, 41 is mounted on shafts 81, 82, which extend the entire width of the housing 11 and are supported by the longitudinal (front and rear) housing walls. Cord pulley set 18 comprises two pulleys 19-19 mounted adjacent the spring drive unit on shaft 88. The spring drive unit is directly connected to the cord pulley unit 18 by a power transfer spur gear set 65 comprising gear 66 which is mounted on spring drive drum shaft 82 and meshes with gear 67, which is mounted on cord pulley shaft 88. When a constant force spring drive is used, obviously the spring force does not track the blind weight or compression. However, the power transfer gear set (1) permits tailoring the spring drive unit to the blind operation in that the gear set 65 can be (a) a 1:1 direct drive so that the unit transmits power directly with only frictional loss, or (b) can have a selected non-direct gear ratio for varying the spring force as described above, and thus assisting in tailoring the spring force to the varying blind weight or compression, and (2) has inherent friction which assists retaining the blind at the selected positions. When a varied force spring drive unit is used, (1) preferably the varied force is tailored to the variation in the supported weight of the blind, (2) the power transfer gear set friction assists in retaining the blind at the selected positions, and (3) the power transfer gear set may be direct drive or have a gear ratio which assists in tailoring the spring force to the varied supported weight or compression characteristics of the blind.

FIG. 15A depicts a spring drive unit which is similar to unit 15B, FIG. 15, and includes a recoil roll or wheel or simply recoiler 154, FIG. 33A, mounted adjacent and in contact with the output spool of the spring drive 31, 41, for facilitating recoil of the spring when needed, preventing "explosion" of the spring, and providing braking action for supplementing the inertia of the unit to maintain the spring and associated window cover in the desired position. It is thought that springs having holes, slots, etc. are more likely to "explode" that are non-perforated springs and thus the recoiler is especially useful with perforated springs.

d. Spring Drive and Transfer Gears (FIG. 16)

Figure 16:
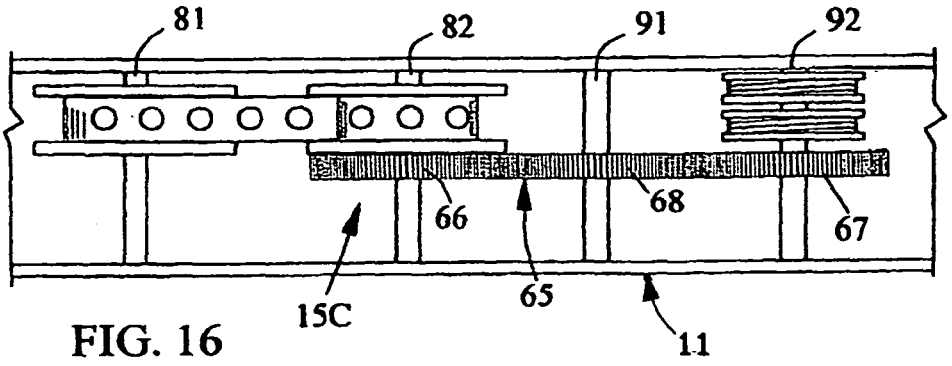

FIG. 16 depicts an alternative embodiment 15C to the spring drive unit 15B, FIG. 15. The compact unit 15C comprises the spring drive 26, 31, 41; the cord pulley unit, and power transfer spur gear set 65. The difference is that the housing 11 contains four shafts 81, 82, 91 and 92, and the power transfer gear set 65 comprises three gears 66, 67, 68. Gear 66 is mounted on shaft 82 as in FIG. 15, and gear 67 is mounted on shaft 92 with pulley set 18. However, middle gear 68 is mounted on shaft 91. The three gear unit 65 operates differently from the two gear unit in that it is a power transfer and/or ratio unit. Otherwise, the unit 15C operates the same as unit 15B, FIG. 15, and the components function as described above with regard to unit 15B.

e. Spring Drive, Band Shift Transmission and Transfer Gears (Coil, FIG. 7C; Flat, FIG. 17)

(1). Coil Spring Applications

FIG. 7C depicts an alternative spring coil drive unit 65C which comprises a coil drive spring 40, fixed ratio gear sets or transmissions 60 and 65, and a continuously varying, varied ratio, cord or band shift transmission 80C. Preferably transmissions 60 and 65 are direct drive but can be other ratios as well. Illustratively, the support or housing 11 includes transverse supports including support, and transverse shafts 43C, 44C and 46C. The spring 40 is mounted along and freely rotatable around a longitudinal shaft 66C, which is journal mounted to spaced transverse supports (only one, of these two supports is shown). One end of coil spring 40 is mounted to support by fastener 76C, and the opposite end of the spring is attached by fastener 77C to the collar 78C of gear 61 of bevel gear set 60. Mating bevel gear 62 is mounted on transverse shaft 43C, interconnected to gear 66 of preferably direct drive transmission 65. Adjacent gear 67 of the transmission 65 is mounted on transverse shaft 44C and meshes with gear 66.

Referring also to FIG. 8C, band shift transmission 80C comprises output drum 81C (or spool) and storage drum 82C (or spool) about which a band 83C is wrapped. Preferably, the cord or band 83C is an elongated strip of thin cloth or thin steel having a flat rectangular cross-section. However, other suitable materials can be used, and other cross-section shapes can be used which provide controlled variation in the radii on the drums. Hereafter the term "band" will be used in accordance with the preferred embodiment of a thin, flat rectangular, but with the understanding that "bands" of other suitable cross-section shape can be used as well. The band shift transmission (hereafter band transmission) provides a varying drive ratio which is used to increase or diminish the torque or force of the spring drive unit. The cord or band transmission applies the varying drive ratio between the spring drive and the lift cord pulleys. The ratio of the band transmission is determined by the radius of the band stored on each drum. The radii vary as the band winds and unwinds, varying the associated gear ratio. Thus, increasing (decreasing) the thickness of the band, increases the rate at which the radii increase and decrease, and increases the gear ratio provided by the transmission. By way of example but not limitation, a band thickness of 0.014 inches has given satisfactory results. The manner of mounting the band can be used to decrease or increase the ratio of the speed of the spring output drum relative to that of the lift cord pulleys as the blind is lowered.

Referring further to FIG. 8C, output drum 81C is mounted on the shaft 44C with gear 72C and take-up drum 82C is mounted on transverse shaft 46C along with cord pulley unit 73C. This is a conventional pulley unit, about whose pulley(s) 74C are wound the spaced lift cords 16 which support the blind, such as blind 10, 20. Structurally, the pulley unit 73C differs from pulleys 18 in that pulleys 74C and 75C are mounted together on a transverse shaft near the right end of the blind, necessitating that one of the cords be routed to the left side of the blind. The pulleys 74C operate the same as pulleys 18.

As shown in FIG. 7C, the direct drive transmission 65 and the pulley unit 73C are mounted parallel to the band shift transmission 80C, reducing the overall length of the spring drive unit 65C. The ratio of the band shift transmission is determined by the radius of the band stored on each drum. The radii vary as the spring 40 winds and unwinds, continuously varying the associated gear ratio. As mentioned, the band mounting can be used to decrease or increase the ratio of the winding or rotational velocity of the spring relative to that of the pulleys as the blind is lowered. Preferably, the band 83C is mounted so the band radius on output drum 82C increases (alternatively, decreases) relative to the band radius on storage drum 81C as the blind is lowered (raised) and the cord-supported weight decreases (increases), thus offsetting somewhat or decreasing the increasing power with which the spring opposes the blind during lowering operation, and offsetting or decreasing somewhat the decreasing lifting power of the spring during raising of the blind, and increasing the distance traveled by the blind relative to the spring drive and thereby increasing the maximum operational length of the blind (the distance between the fully raised and fully lowered positions.

In short, the continuously varying ratio, band shift transmission 80C continuously alters (preferably decreases) the rate at which the spring winds up and the torque increases as the blind is extended lower and alters (preferably increases) the operating length of the blind.

As mentioned, the operationally fixed ratios of bevel gear set 60 and gear set 65 can be direct drive, that is 1:1. Alternatively, the ratios can be smaller or greater than 1:1, to alter the overall ratio of the drive unit such as 65C. The ratios also alter the maximum possible length of the blind and the distance between the open and closed positions of the blind for a given rotational distance traveled by the coil spring. For example, the ratio of at least one of these gear sets can be smaller than 1:1, as described for transmission 50C, FIG. 5, and with similar results. Where the ratios of both bevel gear set 60 and gear set 65 are approximately 1:1, stopping the blind at any of selected positions and keeping the blind at the selected positions are effected by both (1) the continuously varying ratio of the band unit 83C which decreases the change in power of the coil spring as it winds and unwinds, (2) the friction of the bevel gear set 60 and the gear transmissions 50C and 70, and (3) the "buckling" braking action of the spring 66C.

(2). Flat Spring Applications

FIG. 17 depicts a compact spring drive unit 15D which is yet another alternative to the drive unit 15, FIG. 13. The housing 11 contains transverse shafts 81, 82, 91 and 92. Spring drive 26, 31 or 41 is mounted on shafts 81 and 82 and is connected to cord pulley unit 18 by a power transfer gear unit 65 and a band shift transmission or gear unit 21. The power transfer gear unit 65 comprises gear 66 which is mounted on drum shaft 82 and meshes with gear 67, which is mounted on shaft 91. One drum 22 of the band shift transmission 21 is also mounted on the shaft 91 and the second drum 23 is mounted on shaft 92 along with the cord pulley unit 18, which comprises two cord pulleys 19-19 for the lift cords 16 and 17.

When a constant force flat spring drive 26 is used, the unit 15D has several features which improve the operation of the blind despite the limitation of constant spring drive force: (1) the band shift transmission 21 varies the spring force, preferably directly proportional to the varying weight or compression of the blind, (2) the power transfer gear unit 65 may be direct drive or may have a selected gear ratio for additionally varying the spring force as described above, and (3) the power transfer gear unit also provides friction which assists in retaining the blind at the selected positions. Alternatively, when a varied force flat spring drive unit is used, (1) the varied force of the spring drive preferably is directly proportional to the varying weight or compression of the blind, (2) the band transmission provides additional variation of the spring force, preferably directly proportional to the weight or compression of the blind, (3) the power transfer gear unit may be direct drive or may have a selected gear ratio for additionally varying the spring force and (4) the power transfer gear unit also provides friction which assists retaining the blind at the selected positions.

f. Spring Drive, Transmission and Transfer Gears (FIG. 18)

FIG. 18 depicts a compact spring drive unit 15E which is another embodiment of the present invention. The unit 15E comprises a flat spring drive 26, 31 or 41 which is operatively connected to a two-gear power transfer unit 65, which in turn transmits force via transmission 70 to the pulley unit 18, and vice versa. Specifically, the spring drive is mounted on transverse shafts 81, 82; one gear 66 of the set 65 is mounted on the shaft 82 with the associated drum and meshes with the gear 67, which is mounted on shaft 92. Transmission 70 is also mounted on the shaft 92 in the manner described relative to the mounting on shaft 50, FIG. 13, along with the pulley unit 18. As a result, the power transfer gear unit 65 and the transmission 70 transfer force from the spring drive to the pulley unit, and vice versa.

Preferably, a varied force spring drive unit is used, one which exerts diminished force as the blind is lowered, and preferably one which tracks the decreasing supported weight or compression force of the blind 10, 20 as the blind is lowered. The above transmission gear ratios and the different pulley and spring rotation rates diminish proportionately the force exerted by the spring as it is wound and the blind is lowered. The gear ratio also increases the length of travel available to the blind for a given spring, permitting a longer blind for a given spring or a given spring travel. As discussed previously, the power transfer gear unit may be direct drive or may have a selected gear ratio for additionally varying the spring force. Furthermore, the transmission and the power transfer gear set have inherent friction which individually and collectively act as a brake and retain the blind at any selected position between and including fully open and fully closed.

g. Spring Drive, Gear Transmission, Band Shift Transmission and Transfer Gears (FIG. 19)

(1). Coil Spring Applications

FIG. 9C depicts an alternative window spring coil drive unit 95C which adds the transmission 50C to drive unit 65C. That is, coil spring drive unit 95C includes the drive components and functions of the drive unit 65C and the transmission 50C provides an additional fixed gear ratio for use in determining the overall ratio of the drive unit and for providing an additional frictional component which increases the stability of the blind at the selected rest positions.

The various components—gear transmission, shifting flat band transmission, gear set 60 and gear set 65—can be used alone or in essentially any combination to accommodate the weight and operational length of a given bind or cover.

(2). Flat Spring Applications

FIG. 19 depicts an embodiment 15F of the spring drive unit which includes a chain drive for the purpose of transferring power and/or ratio. Illustratively, spring drive 26, 31 or 41 is mounted on shafts 81 and 82; band shift transmission 21 is mounted on shafts 82 and 91; chain drive 94 is mounted on shafts 91 and 92; two pulley units 18, 18 are mounted on shaft 92 for the purpose of powering the cord pulleys; and transmission 70 is mounted on shaft 91 between unit 21 and chain drive 94. The unit 15F features the combination of varied drive force from the spring drive, varied gear ratio from unit 21, constant gear ratio from transmission 70, and frictional holding force from transmission 70.

h. Additional Perforated Spring Embodiments (FIGS. 20-32)

FIGS. 20-32 depict several of the many possible additional embodiments of the perforated spring 44, FIGS. 8 and 12.

Figure 20:
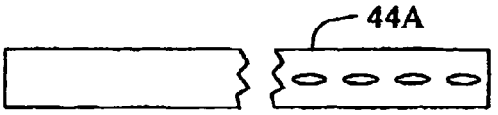

In FIG. 20, spring 44A comprises an array of elongated slots of generally uniform size positioned along the longitudinal center axis of the spring.

The spring 44B of FIG. 21 comprises a similar array of uniform elongated slots, flanked by a line of alternating holes along each outside edges of the spring, with the holes in each line being spaced one hole per two slots.

The spring 44C of FIG. 22 has a similar array of uniform elongated slots, flanked by two lines of holes along the outside edges of the spring, with a hole at each end of the individual slots.

FIG. 23 depicts a spring 44D comprising an array of elongated slots of increasing length positioned along the longitudinal center axis of the spring.

In FIG. 24, spring 44E comprises an array of generally circular holes of the same size positioned along the longitudinal center axis of the spring.

The spring 44F of FIG. 25 comprises an array of generally circular, like-sized holes positioned along the longitudinal center axis of the spring, flanked by lines of alternating holes along the outside edges of the spring, with the holes in each line spaced one hole per two slots.

The spring 44G of FIG. 26 comprises an array of generally circular holes of uniform size positioned along the longitudinal center axis of the spring, flanked by a line of alternating holes along each outside edge of the spring, with the holes in each line being spaced one hole per slot.

In FIG. 27, spring 44H comprises five longitudinal lines of generally circular holes of like size, with the holes of adjacent lines positioned at alternating positions along the spring.

FIG. 28 depicts a spring 44I comprising an array of generally circular holes of increasing radii positioned along the longitudinal center axis of the spring.

In FIGS. 20-22 and 24-26, one end of the spring does not have slots, so that the spring torque or force maintains a relatively constant maximum along the slot-free end.

FIGS. 29 and 30 depict a perforated spring 44K illustratively comprising three sections 112, 113 and 114 which are joined by a tongue-in-groove arrangement 116 (sections 112 and 113) and rivet 117 (sections 113 and 114). The spring torque is controlled by the different cross-sectional dimensions of the sections as well as the size and spacing of the perforations.

FIGS. 31 and 32 depict an alternative, non-perforated sectioned spring 44L, illustratively comprising three sections 118, 119 and 121 which are joined by rivets 122 (sections 118 and 119) and a link 123 (sections 119 and 121). The spring torque is controlled by the cross-sectional dimensions of the sections.

FIG. 42 depicts yet another alternative perforated spring 44M which, illustratively, comprises two laterally spaced parallel rows of longitudinally spaced, longitudinally elongated slots 42. The length of the slots and the spacing between the slots are selected to vary the torque output of the spring along the length of the spring. Slots are preferred to holes because the elongation of the slots has a more uniform cross-section along the width of the spring than circular holes and thus more uniform torque along the length of the slots. FIG. 42A depicts still another perforated spring, an embodiment 44N comprising longitudinally-overlapping elongated slots 42A having round, semi-circular ends 42B. The long, rounded end, overlapping slots enhance the uniformity of the spring cross-section along its width and thus provide uniform (uniformly constant or uniformly varied) torque.

I. Brake Mechanisms, Including Magnetic and Detent Brake Embodiments (FIGS. 33-37)

(1). Magnetic and Detent Brake Embodiments (FIGS. 33-37)

Figure 34:
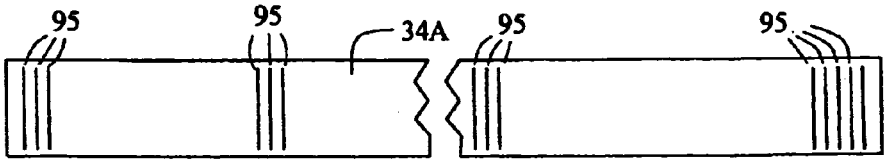
Figure 35:
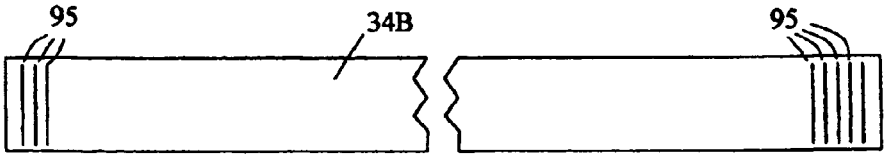
Figure 36:
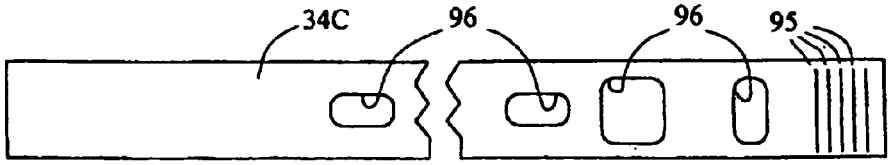
Figure 37:
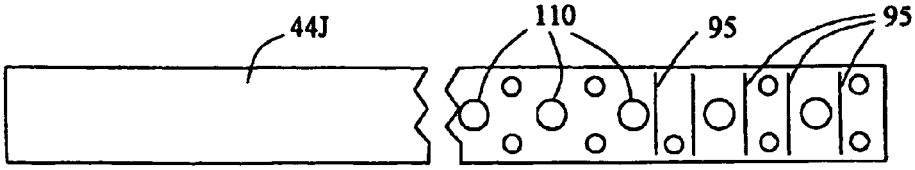

FIGS. 33-37 illustrate the use of magnetic and detent brakes in spring drives. FIG. 33 depicts a spring drive which incorporates two brake devices, a magnet brake 100 and a detent brake 105. Both devices are shown in one figure, although either one or both devices can be used. Regarding magnet brake 100 and referring also to FIGS. 34-37, the spring contains thin magnetic or magnetized sections 95 which in the illustrated embodiment extend transverse (side-to-side) on the spring. Preferably, several of the sections are placed closely adjacent one another at locations of the spring where it is desired to stop the spring, for example at spring positions corresponding to blind fully open and fully closed positions and intermediate positions, including a large number of closely spaced intermediate stop positions. For example, FIG. 34 depicts a varied-cove spring embodiment 34A having magnet strip 95-defined stop positions at a multiplicity of positions. FIG. 35 depicts an embodiment 34B having magnet strip 95-defined stop positions proximate the ends of the spring. FIGS. 36 and 37 illustrate springs 34C and 44J, respectively, having magnet strip 95-defined stop positions at one end of the spring.

Referring now to FIG. 33, the exemplary magnet brake 100 comprises a magnet bar 101 mounted for pivotal movement by pin or shaft 102 which is mounted to the housing 11. Spring 103 is mounted to bar or rod 104 extending from the housing and biases the magnet bar lightly closely adjacent the outside surface of spring such as spring 34A, 34B, 34C and 44J wound on associated drum such as 28. The magnet bar 101 rides lightly along or in close proximity to the spring with no effect on the operation of the spring drive until the bar reaches the magnet sections 95, which are attracted to the bar. Preferably, the magnetic force is sufficient to maintain the spring drive and blind at the given position when the blind is brought to rest at that position, and is sufficient to stop a very slowly moving blind at that position (that is, to stop the blind as a person slows movement of the blind to stop it proximate the position of the magnet strips), but is insufficient to stop the blind as it is raised and lowered at a normal speed.

The detent brake 105 shown in FIG. 33 comprises a bar 106 extending in a transverse direction from the housing 11 adjacent the spring between the associated drums, a detent 107 mounted on a pin 108 projecting downward through a hole in the bar 106, and a spring 109 between the bar 106 and the detent 107 for biasing the detent lightly against the spring. As shown in FIG. 36, the spring 34C may comprise one or a plurality of holes 96 which accept the detent 107. Alternatively, referring to FIG. 37, holes at selected positions in the perforation-derived varied force spring may be of suitable size to accept the detent. The detent 107 has a sloping tip engaging the selected holes with sufficient force to maintain the spring drive and blind at the given position when the blind is brought to rest at that position, and is sufficiently great to stop a very slowly moving blind at that position (that is, to stop the blind as a person slows movement of the blind to stop it proximate the position of the magnet strips), but is sufficiently small (i.e., the detent is sufficiently easily dislodged from the selected holes) to stop the blind as it is raised and lowered.

(2). Recoilers (FIGS. 33A, 33B)

FIG. 33A depicts a braking device in the form of a recoiler roll or recoiler wheel or simply recoiler 154 comprising a hub 156 and a multiplicity of fins 157-157 which extend from the hub, illustratively generally radially. The hub 156 and fins 157 can be formed as an integral unit. Preferably at least the fins (or the fins and the hub) are formed of resilient material such as rubber. The recoil hub is mounted on a shaft 158. The recoiler 154 is mounted adjacent and in contact with an associated spool of a spring drive such as 31, 41, for facilitating recoil of the spring when needed, preventing uncontrolled expansion or "explosion" of the spring, and providing braking action for supplementing the inertia of the spring drive unit to maintain the spring and associated window cover in desired positions.

FIG. 33B depicts another recoiler, embodied in a coil spring recoiler 161 comprising a coil spring 162 attached at one end 163 to the wall of the blind housing and connected at the opposite end to a cord or wire 164 which is wound on a spool 166 mounted coaxially with the storage spool of an associated spring drive such as 31A, 41A. The coil spring recoiler 161 opposes the unwinding of the spring and facilitates recoiling of the spring when needed, preventing uncontrolled expansion or "explosion" of the spring, and provides braking action for supplementing the torque and inertia of the spring drive unit to maintain the spring and associated window cover in desired positions.

j. Large Dimension and Heavy Window Cover Systems (FIGS. 38-41)

FIGS. 38-41 illustrate examples of the use of spring drive units embodying the present invention in large window covers, for example, heavy covers or wide covers.

FIG. 38 depicts a single spring drive unit 15G which includes three lift cords and pulleys. The illustrated drive unit includes a spring drive such as 26, 31, 41 which is connected by a gear set 65 to the shaft on which the three lift cord pulleys 19 are mounted. Typically, the associated cords are routed along vertical paths which are spaced along the width of the wide and/or heavy cover, for uniform raising and lowering of the cover.

FIG. 39 depicts a plural (two or more) drive unit, spring drive window cover system which includes a pair of drive units 15H, each of which is similar to that of FIG. 38, but includes two pulleys 19 and associated lift cords. The spring drives are connected by a power transfer bar unit 125 having bevel gear units 65 on the opposite ends which are connected to the rotating shaft of each spring drive, so that the drives, pulleys, and cords operate precisely in unison. The four illustrated pulleys 19 can be used to route four lift cords along vertical paths which are spaced along the width of the cover, for uniformly raising and lowering the wide and/or heavy cover (See FIG. 41).

FIG. 39A depicts a plural drive unit, spring drive window cover system which is similar to that of FIG. 39, in that the spring drive system includes two single-spring, spring drive units 31 or 41 and two pair of outer pulleys. The illustrated spring drive units 31 (41) are connected in series by a drive train to two-pulley units 18-18 mounted on either side of the spring drive units. The arrangement is well suited to placing plural spring drive units in the interior or middle of the window cover between left and right end pulleys. The window cover drive system also includes a pair of recoilers 154-154, one mounted adjacent and in contact with the farthest left and farthest right spools of the spring drive units. The recoilers 154-154 facilitate recoil of the associated spring when needed, prevent "explosion" of that spring, and provide braking action for supplementing the inertia of the spring drive units to maintain the springs and associated window cover in desired positions.

FIG. 40 depicts a plural drive unit, spring drive system comprising a pair of spring drive units 15I similar to the units 15G of FIG. 38, but with only one pulley 19 in each unit. This system is used for a two lift cord system, typically for heavy covers.

FIG. 40A depicts a plural drive unit, spring drive system which includes two spring drive units and a two pulley unit 18 on one side of the spring drives. A gear train is connected between the output spool of each drive unit and the associated pulley unit. Each spring drive 31A or 41A comprises a pair of springs mounted in parallel on a single storage spool (or integral/joined storage spools) and a single output spool (or integral/joined output spools).

At this point, a note regarding spring drive terminology may be helpful. First, herein the phrases "plural drives," "plural drive units," "plural drive unit, spring drive system" and the like refer to a system comprising two or more spring drive units. See, for example, FIGS. 39, 39A, and 40, which depict different arrangements of window cover systems, each of which includes two spring drive units such as 26, 31 or 41. Second, the phrases "plural-spring unit," "plural-spring drive unit," "plural-spring, spring drive unit" and the like refer to an individual spring drive unit which comprises two or more springs. See, for example, FIGS. 45 and 52, wherein each of the spring drive units 26A, 31A, 41A and 131 comprises two springs. In FIG. 45, the two springs of the spring drive unit 131 have separate storage spools 132 and 134 and a common output spool 136. In FIG. 52, the spring drive unit 26A (or 31A or 41A) comprises two springs mounted in parallel on a single storage spool (or integral/joined storage spools) and a single output spool (or integral/joined output spools). Finally, please note that systems can comprise plural drive units, of which one or more is a plural-spring drive unit. See, for example, FIG. 40A. The plural-spring drive unit; plural drive unit systems; and combinations thereof are used to increase the torque/force available for operating heavy coverings and to provide separate drive units near the cord pulleys in wide coverings.

FIG. 41 depicts representative examples of the lift cord paths for two and four cord systems.

FIGS. 49 and 50 are a front perspective view, partially broken away, and a top plan view of a compact, simple high torque spring drive system. A varied torque spring drive 31A or 41A or, preferably, a constant torque drive unit 21A is used which comprises a pair of springs mounted in parallel on integral or joined storage spools and output spools, and thereby provides increased torque for positioning heavy blinds. The spring drive is connected via a direct drive or varied transfer gear train 183 comprising gear wheels or sprockets 184, 185, 186 to a pulley unit 18 comprising pulleys 19-19 mounted on a shaft which is parallel to the shafts of the output and storage spools and transverse to the housing.

As mentioned, FIG. 51 is a perspective view of an embodiment of direct or varied ratio cord pulley system 175, comprising a pair of pulleys or spools 176 and 178 having selected diameters at different axial positions for precisely controlling their ratio. Illustratively, the pulleys 176 and 178 are reverse oriented, conical pulleys or spools 176 and 178. The spools are mounted for rotation on shafts 177 and 179 which correspond to the spool axes and have continuous grooves 181 and 182, FIG. 52, which wind axially around the spools for receiving cord 178 and preferably winding cord as a single layer.

The pulley system 175 operates similarly to the flat band transmission system 21, except that the diameter of each of the spools 176 and 178 can be varied with respect to their longitudinal axes so that as the spools are wound and unwound, their ratio at a given covering/blind position is determined by the spool diameters at the axial cord position corresponding to the covering/blind position, not by the diameter of the wound cord layers, and thus their ratio can be varied precisely over a wide range of values.

It is to be emphasized that the pulley system 175 is not limited to conical shapes. Rather, the shape is that which provides the desired diameter ratios axially along the spools. The force requirements for a given system may best be accommodated by decidedly non-conical configurations. Generally, the output-controlled configuration of the spools is an elongated cylinder of controlled and selectively varying axial diameter.

FIG. 52 depicts an alternative embodiment 180 to the embodiment of the compact drive system of FIGS. 49 and 50, which is modified by the inclusion of a varied ratio cord pulley system 175. In this embodiment, the pulley system shafts 177 and 179 are mounted to sprockets 187 and 188 which are inserted between the pulley sprocket 186 of the gear train and the intermediate sprocket 185 of the gear train. The result is a compact drive system which nonetheless has high maximum torque that can be varied over a wide range of values to accommodate the changing supported weight of a heavy window cover.

k. Plural Spring, Spring Drive System (FIGS. 43-45, 53-57)

FIGS. 43-45 depict a compact spring drive system 15J embodying the present invention and comprising integrally formed plural spring drives. The spring drive system comprises plural (two or more) spring drives which share components and are aligned along the width of the associated blind. This integrated alignment provides force multiplication without increasing the size of the associated housing 11 and, specifically, without requiring a taller housing 11. Referring specifically to FIGS. 43 and 44, the illustrated two spring, spring drive system 131 comprises a first spring drive comprising storage drum or spool 132, common output or power drum or spool 136 and spring 133. The second spring drive comprises storage drum or spool 134, common output or power drum or spool 136 and spring 135. As perhaps best shown in FIG. 44, the spring 133 is routed from its storage drum 132 beneath the drum 134, from which point the two springs are routed together, with spring 133 under spring 135, over and around common output or power drum 136. In effect, the individual torques of the plural springs are added together. The two storage spools are mounted for independent rotation so that outer spool 132 can rotate faster than inner spool 134. This is because the diameter of spring 133 on spool 136 is greater than the diameter of spring 135 and thus spring 133 rotates faster on its spool 132 than does spring 135 on its spool 134. Different types of springs can be used. For example, illustrated spring 135 is a conventional flat spring which provides substantially constant torque, and spring 133 is perforated so that the torque varies along the length of the spring proportional to the operational characteristics of the associated blind, as discussed previously. The combined springs provide a combined increased, varying torque sufficient for supporting heavy blinds, yet tailored to the different force requirements as the blind is raised and lowered.

FIG. 45 depicts one embodiment 15J of a spring drive unit which uses the two spring, spring drive 131. The three spools 132, 134 and 136 are mounted on transverse shafts 81, 82, 91, respectively, spaced along the width (horizontally) of the associated housing 11. Gear 66 of gear set 65 is mounted on shaft 91 with the output or power spool 136 and meshes with gear 67, which is mounted on shaft 92 along with the cord pulley set 18 comprising right and left side cord pulleys 19, 19. Of course, the other components such as transmissions 50 and 70 and bevel gear set 60 can be used for transferring power from the spring drive to the cord pulleys and controlling the applied power, the travel of the blind relative to that of the spring drive, and the inherent, braking action. Furthermore, three or more springs can be used by the simple expedient of providing additional storage drums or spools and routing their associated springs together over and around the common output or power spool 136. For example, a third spring can be added to the drive 131, FIG. 43 and 44 by adding a third storage spool spaced generally horizontally to the left of spool 132, and routing the third spring beneath spring 133. Please note, as alluded to previously, this presents the opportunity to multiply the torque without increasing the size of the spools and the height of the housing 11. In contrast, in the plural spring system, the torque is increased by substantially a factor of two simply by adding a second spring the same size as the first spring. In effect, the increased spring mass required to multiply the torque can be provided by adding additional springs positioned along the horizontal axis of the spring drive, rather than by increasing the spring mass and spool diameter (and thus the height of the spool and the housing), as is the case where a single spring, spring drive is used.

In the embodiment shown in FIG. 45, the storage drums are arranged in a horizontal straight line, or approximately a straight line. In addition, both the output drum and the storage drums are arranged along the horizontal straight line. Alternatively, the storage drums or both the output drum and the storage drums can be positioned along a vertical line. Alternatively, the storage drums can be arranged in a cluster, or both the output drum and the storage drums can be arranged in a cluster.

FIG. 53 is a top plan view of a section of a simple high torque spring drive system. A varied torque spring drive 31A or 41A or, preferably, a constant torque drive unit 26A is used which comprises a pair of springs mounted in parallel on integral/joined storage spools and output spools. The spools are mounted on shafts which are oriented transverse to the housing. The plural spring, drive system provides increased torque for operating heavy blinds. The spring drive is connected via a direct drive or varied ratio transfer gear train 183 comprising gear wheels or sprockets 184, 185, 186 to an automatic locking pulley cord unit 190, FIG. 54, which includes a pulley 191 and raise/lower cord 192 wrapped around the pulley. In the exemplary drive system, the pulley shaft 50 is oriented transverse to, 90° relative to, the spring drive shafts and the shafts of the transfer gears 183, and is connected to the shaft 186 of the output pulley by a 90° bevel gear unit 60. The pulley cord unit 190 is used to operate the associated window cover or blind, that is, to raise and lower the window cover, and incorporates an automatic locking mechanism that prevents accidental movement of the blind, yet is easily and automatically overridden when the pulley cord system is operated. Although the locking pulley cord draw system 190 is desirable in heavy and/or high torque window cover systems, it is applicable in general to window cover and other systems where a shaft is rotated by a pulley cord system.

Referring also to FIG. 54, in the illustrated exemplary arrangement, the pulley cord pulley unit 190 includes and is mounted within a housing 193 comprising front wall 194, top wall 196 and bottom wall 197. The pulley 191 is mounted on and rotates together with shaft 50, which extends through a bushing 198 having a circumferential groove 199 that is received by vertically elongated slot 201 in front wall 194, thereby mounting the bushing in the slot and allowing the bushing, shaft 50 and pulley 191 to move up and down.

The automatic locking mechanism includes a compression spring 202 which is positioned between the bottom wall 197 and the bushing 198 and biases the bushing 198 against the top of the slot 201. A threaded adjustable screw or pin 203 is mounted through the top wall 196 of the housing and mates with a series of slots 204 in the periphery of the pulley 191. Referring also to FIG. 55, the spring 202 normally biases the pulley 191 against the screw 203, locking the screw in one of the slots 204, preventing rotation of the pulley and preventing raising or lowering movement of the cover or blind. In short, the locking mechanism prevents the blind from moving from its selected position. Referring also to FIG. 56, when the front or back section of the cord is pulled downward to raise or lower the blind (alternatively, to lower or raise the blind), the spring 202 is overcome and the pulley 191 is moved downward and out of engagement with the locking screw 203, allowing the pulley to rotate and the blind to move/be moved as desired. When a desired position is reached, the cord 192 is released, allowing the spring 202 to automatically lock the pulley 191 on the screw 203.

As shown in FIG. 57, the pull cord 192 is routed over the pulley 191 and the section of the cord which extends downward from the rear of the pulley can be routed by a guide pulley 206 to a position adjacent the front section of the cord, and from there both sections are routed by close-spaced bushings 207 and 208 through apertures in the bottom wall 197 of the housing and exit the housing. As alluded to above, when one of the cord sections is pulled, the locking mechanism is released, and the pulley 191 can be rotated to raise or lower the blind. After the blind is positioned as desired, the cord is released, allowing the anti-rotation locking mechanism to automatically re-engage and to maintain the blind in the selected position.

The locking cord system 190 provides access to coverings (and their associated housings) from a distance and thus is useful for coverings which are difficult or awkward to reach, for example, a covering which is located high on a wall, and a covering access to which is obstructed, for example, by furniture. Also, the use of the various spring drives, transmissions, etc. and combinations thereof contemplated herein result in little effort being required to operate a covering using the cord.

FIGS. 58 and 59 are top plan views of a section of simple high torque spring drive systems 160 and 185, respectively, according to the present invention. The systems incorporate wand or crank units according to the present invention which operate, that is, raise and lower the associated cover or other load. Each exemplary system 160, 185 includes one or a plurality of constant and/or varied torque spring drives selected from 26A, 31A and 41A or, preferably, constant torque spring drive 26A, which illustratively comprises a pair of springs mounted in parallel on integral/joined storage spools and output spools. The spools are mounted on shafts which are oriented transverse to the housing. The plural spring drive system provides increased torque for operating heavy blinds. The spring drive 160, FIG. 58, or 185, FIG. 59, is connected via a direct drive or varied ratio transfer gear train or transmission 183 comprising gear wheels or sprockets 184, 185, 186 to crank unit 210, FIG. 60, or to crank unit 225, FIG. 61. Crank unit 210 has relatively greater automatic braking action, whereas embodiment 225 is a relatively free-running crank unit of relatively lesser braking action. Both units incorporate a crank such as 217, FIGS. 62 and 63, which comprises hinged sections 218, 219 and 221 that permit operating the crank unit from a position beneath the spring drive housing.

Referring to FIGS. 58 and 60, crank unit 210 comprises transverse, horizontal shaft 211, on one end of which is mounted output sprocket 186 of gear train 183. The shaft 211 extends through a bushing to the front exterior of the spring drive housing. A universal joint 212 pivotally mounts crank 217, FIGS. 62 and 63, to the second end of the shaft 211. The universal joint 212 comprises a connector 213 mounted to the external end of shaft 211, a connector 214 mounted to the upper end of the crank, and an H-shaped connector 216 pivotally mounted to and between the other connectors. Typically, the bent crank, FIG. 63, can be used to raise and lower the blind by rotating the crank end 218 about the axis of the crank upper section 221, so long as the crank upper section 221 is oriented at an acute angle, typically less that 45° to the axis of shaft 211. However, when the crank 217 is released, gravity causes it to assume the near-vertical orientation shown in FIG. 60, and rotation of the crank about its near vertical longitudinal axis does not rotate the shaft 211 about its longitudinal axis, and vice versa. This is because rotation of shaft 211 would cause the transverse-oriented crank 217 to rotate much like a propeller. As the result of the torque which is required for this rotation, the crank acts as a brake against rotation of the shaft 211 and unwanted movement of the associated blind.

Referring now to FIGS. 59 and 61, crank unit 225 comprises a shaft 226 which is journaled diagonally from the top of the drive housing through a bushing in the front wall. One gear 229 of a worm gear unit 227 is formed on the shaft 226 and the other gear 228 is mounted or formed on shaft 219, FIG. 59, which is connected by bevel gear unit 60 to the output sprocket 186. Universal joint 212 pivotally mounts crank 217 to the external end of the shaft 226. The universal joint 212 comprises connector 213 mounted to the external end of shaft 226, connector 214 mounted to the upper end of the crank, and H-shaped connector 216 pivotally mounted to and between the other connectors. As mentioned above, typically, the bent crank, FIG. 63, can be used to raise and lower the blind by rotating the crank end 218 about the longitudinal axis of crank upper section 221, so long as the crank upper section is oriented at an acute angle, typically less that 45°, to the longitudinal axis of shaft 226. Unlike unit 210, at rest shaft 217 hangs at an angle of less than 45° to the angled shaft 226. As a result crank 217 itself is relatively free-running, that is, without propeller rotation, in the release or rest position: rotation of the crank 217 about its longitudinal axis is translated into rotation of the permanently angled shaft 226 about its longitudinal axis. To raise or lower the associated blind, the bent crank is rotated as described above, and the rotation is translated into rotation of shaft 219, the spring drive, and the associated cord pulleys (not shown), and movement of the cover.

As alluded to above, when in the release position, crank 217 rotates the worm gear unit 227 and moves the cover or other load without difficulty. In contrast, when at the release position, the gear 228 of the worm gear unit is "locked" by gear 229, that is, it is difficult to use gear 228 to move gear 229, and as a result the worm gear unit opposes movement of the cover, for example, after the crank is used to move the cover to a selected position and the crank is released. Please note, and as explained elsewhere, the gear train or transmission 183 and the spring drives (and other components such as transmissions and gears) which are used for both systems 160 and 185, as well as the worm gear unit 227 which is used in system 160, provide inertia and friction which facilitates keeping the associated load(s) at the desired position.

FIG. 60 illustrates an anti-rotation brake in the form of a bracket 234-supported bolt 231 having a pad 233 at its outer end which is biased by spring 232 against axle 219 to provide frictional braking which suppresses unwanted movement when the crank is released, but is easily overcome by rotation of the crank when it is desired to raise or lower the blind.

Similar to the cord system 190, the crank systems 210 and 225 are especially useful in systems having coverings which are awkward or difficult to reach for extending and retracting, for example, because the covering is located high on a wall, or because access to the covering is obstructed, for example, by furniture. Also, the use of the various spring drives, transmissions, etc. and combinations thereof contemplated herein result in little effort being required to operate the covering using the crank. In addition, the combination of the various spring drives, transmissions, gears, etc., in combination with a cord or crank system, provides ease of operation, stability against unwanted movement, and accessibility. The crank systems may be preferred to the cord system for accessibility, because the cord typically has to be pulled taut for operation and frequently is anchored at its bottom end to the wall, whereas the crank is inherently rigid and can be pulled away from the wall for operation, thereby more easily circumventing obstacles and more easily providing access from a distance in such circumstances.

l. Non-Locking Crank (FIGS. 64-70)

The spring drive units and systems described herein are designed to offset or counteract (1) the differences or variations in the supported weight of blinds at different positions and/or the inherently opposite variation of the torque of spring drives; (2) the increased differences in supported weight for heavy blinds; and (3) the inherent difficulty in using spring drives with long window covers, that is, window covers that traverse a long distance between the open and closed positions. Regarding (1) for example, a cover having a supported weight of ten pounds at the top, open position may have a supported weight of one pound at the bottom, closed position.

Above-described FIGS. 58-63 depict crank-assisted systems which use cranks to provide a torque or motive force supplemental to that of the spring drive unit(s) or system(s). Although the cranks of FIGS. 58-63 can be used in balanced systems according to the present invention in which the spring torque is approximately equal to (balanced with) the supported blind weight during extension and retraction, they are especially applicable to unbalanced systems, in which the torque of the spring unit(s) or system(s) does not balance the supported weight of the cover and/or where a separate brake is necessary to maintain the position of the cover at some even if not all positions.

In balanced systems according to the present invention, the cover can be extended and retracted using a crank as described herein; using a pull cord or chain; and manually, that is, by manually pulling and pushing the cover itself, typically by grasping the bottom rail. Other motive forces and components described herein such as motors can be used if desired.

FIGS. 64-70 depict other embodiments of crank-assisted spring drive unit(s) and system(s) according to the present invention, which are useful in unbalanced systems, but are especially adapted to the balanced systems according to the present invention in which the torque of the spring drive system and the supported cover weight are approximately equal throughout the path of travel between the extended and closed positions. These embodiments are simple and easy to operate and, although the crank is easily detached, the crank need not be detached for spring-, powered- or manually-assisted operation (for example, for opening or closing a cover after gripping it by hand typically most conveniently proximate the center.

Please note, because the crank of FIGS. 64-70 does not interfere with the operation of the cover, the crank can be mounted to the cover system without interfering with other components and modes of operation such as cord, chain or manual. In a preferred embodiment, the crank uses connecting gears such as bevel gears which don't act as a brake so that the cover can be operated by crank, cord or pulley, or by hand. In contrast, the worm gears such as gear 227, FIGS. 60 and 61, act as a brake and impede operation of the cover unless the crank is disconnected.

Referring now to the crank-assisted embodiments of FIGS. 64-70, FIG. 64. is a top plan view of a section of a simple high torque spring drive system shown with the cover removed. A varied torque spring drive 31A or 41A or a constant torque drive unit 26A is used which comprises a pair of springs mounted in parallel on integral/joined storage spools and output spools. The illustrated spools are mounted on shafts which are oriented transverse to the housing. The plural spring, drive system provides increased torque for operating heavy blinds. The spring drive is connected to a direct drive or varied ratio transfer gear train 183 comprising gear wheels or sprockets 184, 185, 186. Sprocket 186 is connected by a 90° bevel gear unit 60 to shaft 50 which is oriented transverse to, 90° relative to, the spring drive shafts and the shafts of the transfer gears 183. Shaft 50 is connected by another 90° bevel gear unit to shaft 391 of crank unit 390.

The crank 390 can be one piece or can be a hinged unit such as crank 217 shown in FIGS. 62 and 63. In addition, whether one piece or hinged, the crank can be removably attached to the drive system and window cover. Referring also to FIGS. 65 and 66, in a preferred embodiment, the crank unit 390 comprises shaft 391, crank 392 and a sleeve 393 which joins the shaft 391 and crank 392 at adjacent ends thereof. The sleeve 393 preferably is flexible material such as plastic which provides a friction fit with the shaft 391 and/or crank 392, yet is easily removed by pulling. As shown, in one embodiment the sleeve 393 is mounted over the upper end of the crank 392 by joining means such as glue, screw(s), etc. and can be removably attached over the lower end of shaft 391. As a result, the crank 390 can be attached to the shaft 391 for extending or retracting the cover, and is easily removed from the shaft 391 for storage and to avoid the appearance of a depending crank. Of course, numerous other joining techniques will be applied by those of skill in the art.

As mentioned, a crank such as crank unit 391 can be used in non-balanced systems as well as in balanced systems. The crank is useful in hard-to-reach applications, for example (1) window covers which are positioned behind furniture or other obstacles so the end of the window cover (where the pull cord typically is positioned) is difficult to reach and/or the middle of the cover (a cover typically is gripped in the middle for manual operation) is difficult to reach, or (2) window covers which are too tall for manual operation.

FIGS. 67 and 68 are, respectively, a partial front section view and an end section view of a spring drive/window cover system which has a front-emergent pull cord or chain (hereafter pull cord). That is, pull cord 394 enters the housing 11 via one or more holes 397 in the front of the housing. FIGS. 69 and 70 are, respectively, a partial front section view and an end section view of a spring drive/window cover system which has a similar, but bottom-emergent, pull cord or chain (pull cord). That is, pull cord 396 enters the housing via one or more holes 398 in the bottom of the housing. As illustrated, in one exemplary approach, both pull cords 394, 396 are connected to the cover drive by means of associated pulleys 399, 401 mounted on shaft 50 which is connected by a 90° bevel gear unit to gear sprocket 186 of gear train 183. Optionally, a brake can be applied to each pull cord. For example and as shown in FIGS. 67 and 69, a threaded adjustable screw or pin 203 is mounted through the pulley housing wall and engages the pulley shaft 50. The associated frictional force is adjusted by tightening and loosening the screw.

As alluded to above, disengagement of the pull cord (or chain) 394, 396 or the crank 391 is unnecessary, because the associated cover can include both the pull cord and the crank and can be operated by either one independent of the other. In such a system, for the crank positioning depicted in FIG. 64, the pull cord typically would be at a location spaced from the crank, such as at the opposite end of the housing 11. In this arrangement, the pull cords would be moved to the opposite end of the housing 11 and the associated drawing would be the mirror image of the views depicted in FIGS. 67 and 69.

m. Battery-Assisted Spring Drive System (FIGS. 46-48)

FIGS. 46-48 depict several embodiments of battery-assisted systems in accordance with the present invention. A DC battery-powered electric motor 167 of a type known in the art is connected to the pulley 19 or pulley unit 18 by various drive systems, including a chain drive connection 170, FIG. 46, comprising a sprocket 169 and chain 168; a belt drive connection 175, FIG. 47, comprising a pulley 172 and cord or belt 171; and a shaft drive connection 180, FIG. 48, comprising a shaft 173 connected to the pulley shaft via bevel gear set 60. Aided by the spring drive(s), transmission(s), etc. a small electric motor 167 easily raises and lowers the cover/blind, and can be operated at the blind, for example, by a wall switch, or remotely, by stationary and/or portable controls.

Similar to the single spring drive systems, in one embodiment, at least one of the flat springs is adapted for imparting a torque component to the system torque which varies along the length of that spring. In a specific embodiment, the said spring has a cove or transverse curvature which selectively varies along the length of the spring for providing the torque which varies proportional to the transverse curvature of that spring at a position closely adjacent the output drum. Alternatively, the said spring has at least one hole therein for providing a torque proportional to the transverse size of the hole and the resulting effective width of that spring when the hole is positioned closely adjacent the output drum. In another alternative embodiment, the said spring has holes along its length for providing a torque which varies proportional to the transverse size of the holes and the resulting effective width of the spring when one or more holes is positioned closely adjacent the output drum.

It should be noted that the cover or blind housing which mounts the blind and the spring drive can be mounted along the bottom of the window or other surface to be covered, so that the blind extends upward for closing and retracts downward for opening. For convenience, in this document we describe the operation of top mounted, downward opening blinds and spring drives. However, it is understood that the invention is applicable to upwardly closing blinds, which typically have a bottom-mounted spring drive unit mount. The versatility of the spring drive system according to the present invention in adapting the spring torque characteristics to the operational characteristics of a given cover or blind as well as the braking action of the, make the system applicable to blinds of any operating orientation (top, bottom, lateral, etc.), weight and length.

4. Reversible Multiple-Stroke Control Rod Mechanism a. Overview of Rod-Controlled Cover System FIG. 71 depicts one embodiment 520 of a reversible, plural stroke, rod-comprising or wand-comprising control mechanism or means in accordance with the present invention. The control mechanism 520 is adapted to and for connection to many different loads, including articles, devices and machines, which include a rotatable shaft or rod. Thus, while covers and in particular window covers are described here as applications, it is emphasized that the control mechanism is adaptable to various loads.

FIGS. 84, 85, 86 and 87 are top views of alternative embodiments 510, 511, 512 and 513, in accordance with the present invention, of the cover systems depicted in FIGS. 52, 52, 59 and 64, respectively.

In the exemplary cover systems 510, FIG. 84, and 511, FIG. 85, a control mechanism 520 in accordance with the present invention is connected to a single or plural spring-driven, band transmission-controlled cover system 180, FIG. 52. In cover system 510, the connecting means includes a worm gear unit 227, which is associated with the control mechanism 520, and an intermediate bevel gear set 60 which operatively interconnects the transverse-oriented shafts of the worm gear unit and the gear train 183. Please note, as used in this document, "plural" means one or more and includes "multiple" and vice versa.

Cover system 511 includes a first bevel gear set 60, which is associated with control mechanism 520, and a second, intermediate bevel gear set 60 which interconnects the transverse-oriented shafts of the first bevel gear set 60 and the gear train 183.

In exemplary cover systems 512, FIG. 86, and 513, FIG. 87, the control mechanisms 520 are connected to single or plural spring-driven cover systems 160, see FIGS. 59 and 64. For cover system 512, the connecting means includes a worm gear unit 227, whereas exemplary cover system 513 includes only bevel gear connecting means 60.

The control mechanism 520, FIG. 71, has the unique ability to reversibly rotate shafts which are associated with various loads and to rotate the shafts over much larger rotational distances than would be possible using a conventional single stroke mechanism. Thus, as applied to covers, a single control mechanism 520 can extend and retract even very long covers. Exemplary covers include slat blind cover 12, FIGS. 1 and 2, and pleated blind cover 22, FIGS. 3 and 4. Implementing this capability involves, for example, moving handle 526 device in a selected direction to move the cover in a selected direction, then moving the handle device in the opposite direction to position/reposition the handle device for another load-moving stroke.

Please note, the cover system 180, FIGS. 84 and 85 (also cover system 160, FIGS. 86 and 87) depicts one of the illustrated springs of spring system 26A, 31A, 41A in phantom, to emphasize that the system can comprise one or two or other pluralities of springs. In general in this document, disclosed single springs systems can comprise plural springs, and disclosed plural springs can be single springs.

Referring further to FIG. 71, the control mechanism 520 comprises an elongated rod or wand 522 having spiral ribs 524 or threads which extend along the longitudinal axis of the rod. The handle device 526 is fitted to the rod 522 and is retained on the bottom of the rod, that is, prevented from rotating off the bottom of the rod, by a preferably removable retainer 528, which is mounted on the bottom end of the rod and is secured thereto by a set screw or other joining means.

Referring to FIGS. 71-79, handle device 526 comprises a first elongated cylindrical member 530 (also called "handle member" or "handle means") and a second elongated, stepped cylindrical member 532 (also "inside cylinder" or "thread follower" or "spiral thread follower means"). Referring in particular to FIGS. 74-77, spiral thread follower 532 comprises relatively long lower cylindrical section 534 ("cylinder" or "tube") of relatively small outer diameter selected such that the cylindrical section rotatably and slidably fits within interior bore 538 of handle member 530, and a relatively shorter upper cylindrical section or collar 536 (also called "collar means" or the like), which has a relatively large outside diameter in comparison to that of the lower section 534.

Referring in particular to FIGS. 72, 74, 78 and 79, lower cylinder 534 is longer than handle member 530 and has a peripheral groove 540 proximate the lower end thereof for receiving a split ring 542. The collar 536 and the split ring 542 retain the collar 532 on the handle member 530. See FIG. 72. A washer 544 can be fitted between the split ring 542 and the bottom end of the handle member 530 to facilitate the rotation of the members 530 and 532 relative to one another.

Referring to FIGS. 71 and 75, member 532 has a longitudinal bore 546 comprising upper bore section or bore 548 contiguous with elongated lower bore section or bore 550, the diameter of which is preferably slightly larger than the outside diameter of rod 522, to permit sliding movement along rod 522. Referring to FIG. 75, the exemplary upper bore section 548 has a generally "x" transverse cross-section in which the four intersecting sections are perpendicular to one another. The bore 548 fits over the spiral ribbed rod 522 and follows the curvature of the spiral ribs 514 (and vice versa) and thus effects spiral rotation of the member 532 about the rod (and vice versa).

b. Summary of Operation

Referring to FIG. 71, with the handle device 526 assembled so that the spiral thread follower 532 is rotatably mounted and retained within handle member 530 and with the assembled handle device 526 mounted along the spiral rod 522, operation of the handle device can be selected so that movement of the handle device along the rod in opposite directions (1) moves the handle device along the rod without rotating the rod or (2) causes the rod to rotate in selected, opposite directions. (Condition (1) assumes inertia or friction sufficient to keep the rod from rotating when the handle device is moved along the rod.) Specifically, (1) manually gripping the handle device 530 without gripping the collar 536 (or without gripping the collar with sufficient force to prevent rotation) and moving or translating the control handle along the rod 522 in either direction allows the spiral thread follower member 532 to rotate freely about and along the rod without rotating the rod itself; whereas (2) manually gripping the collar 536 alone or gripping both the handle member 530 and the collar, and moving the handle device 526 along the rod 522 in either direction causes the rod to rotate within the collar in one direction or the other.

Using the handle device 526 to effect bidirectional rotation of rod 522 and also to position or reposition the handle device without rotating the rod permits the control mechanism 520 to extend and to retract covers to any selected position between fully retracted and fully extended.

The touch-operated cover systems 160 and 180 and the reversible, plural stroke, control rod mechanism 520 are designed to operate separately or together and thus, when the control rod mechanism is not gripped, the rod is free to rotate and the associated cover can be extended and retracted by touching or holding the cover, preferably along the bottom rail, and pushing the cover upward or pulling it downward. The spring drive(s) and the band transmission(s) and the associated gear(s) and transmission(s) are selected to counterbalance the varying supported weight of the cover at different positions and as a result only a small force is required to move the cover up or down to different positions, but small inertia and/or frictional drag of the cover system are sufficient to maintain the cover in the selected position.

c. Plural Stroke Operation (1). Cover Retraction (FIGS. 80 and 81)

The reversible, plural stroke operation of the control mechanism 520 is illustrated schematically in FIGS. 80-83. These figures assume the control mechanism is incorporated into a (window) cover system such as, for example, systems 510-513 depicted in FIGS. 84-87.

Referring initially to the cover raising/retracting operation depicted in FIGS. 80 and 81, these figures depict a handle positioning stroke, FIG. 80, and a cover positioning stroke, FIG. 81, which together encompass a cycle of retraction operation. In FIG. 81, the initial positions of the handle device and the cover at the start of the cover positioning stroke are both indicated by a single reference letter "A," whereas the ending positions of the handle device and the cover are indicated by "B."

Referring to FIG. 80, initially, if the control handle device 526 is not in the desired starting position, it is gripped by the handle member 530 (without engaging the collar 536 or without applying sufficient force to the collar to prevent rotation of the spiral thread follower member 532) and is moved downwardly along the rod 522 as indicated by arrow 560 to a lower starting position, which is designated by letter "A" in FIG. 80. During this downward stroke of the handle device 526, the member 532 rotates freely around the rod 522 without engaging the rod, as indicated by arrow 562, thereby allowing the handle device to be repositioned without rotating the rod and without moving the associated load such as cover 12 or 22. Quite obviously, if the preferred handle device starting position is above the initial position, the handle device can be moved upwardly along the rod, rather than downwardly, to the desired position.

Referring to FIG. 81, with the handle device 526 positioned suitably at "A", the handle device is gripped by the collar 536 (or by the collar and the handle member 530) and as indicated by arrow 564, the handle device is moved upwardly along the rod 522, to position "B." Gripping the collar 536 and holding the collar against rotational movement during the illustrated upward movement of the handle device 526, causes the stationary collar to rotate the spiral rod 522, as indicated by arrow 566, and thereby to retract or raise the associated cover, as indicated by arrow 568, to its position "B".

After the cover-raising stroke of FIG. 81, the handle device 526 can be moved as shown in FIG. 80, to reposition the device for a subsequent cover-moving stroke, or simply to move the device to a different or preferred position along the rod 522.

The cover retracting and handle device repositioning cycle is repeated as and if required until the cover has been moved to the desired position, then the handle device is released and the inherent friction and inertia of the cover system such as 510, 511, 512 or 513 counterbalance the supported weight of the cover and maintain the cover at the selected position.

(2). Cover Extension (FIGS. 82 and 83)

FIGS. 82 and 83 illustrate schematically the reversible, plural stroke operation of the control mechanism 520 as used to extend (lower) the cover of an associated cover system such as, for example, a system selected from the cover systems 510-513 depicted in FIGS. 84-87.

Referring to FIG. 82, initially if the handle device 526 is not in the desired starting position, the handle member 530 is gripped (without engaging the collar 536 or without applying sufficient force to the collar to prevent rotation of the collar) and the handle device is moved upwardly along the rod 522 as shown by arrow 570, to a starting position at C, during which stroke the collar rotates freely around the rod as shown by arrow 572, so that the rod 522 doesn't rotate.

Referring to FIG. 83, handle device 526 is then gripped at collar 536 (or by both the collar and handle member 530) and the handle device is moved downwardly along rod 522 (see arrow 574), to position D. Gripping collar 536 and holding the collar against rotational movement causes the stationary collar to rotate spiral rod 522 (see arrow 576), during downward movement of handle device 526, and thereby extends or lowers the associated cover to its associated position D.

After the cover is lowered, handle device 526 can be moved as shown in FIG. 82, to reposition the handle device for a subsequent cover-moving stroke or simply to leave the handle device at a different or preferred position along the rod.

The cover extending/handle repositioning cycle is repeated as/if required until the cover has been moved to the desired position, then the handle device is released and the inherent friction and inertia of the cover system such as 510, 511, 512 or 513 counterbalance the supported weight of the cover and maintain the cover at the selected position.

d. Other Considerations

The pitch of the spiral ribs or threads can be decreased or increased to change the rod's speed of rotation which is effected by the handle device and thereby increase or decrease the speed of movement of the cover or other load.

Quite obviously, the cover/load extension and retraction strokes and cycles and the handle device positioning strokes can be combined in essentially any combination. For example, various combinations of strokes be used to move the cover or other load attached to the reversible, plural stroke control mechanism 520 to different positions and in different directions and to reposition the handle device 526 as desired. Also, one or more extension or retraction strokes can be used to more precisely position the cover after one or a plurality of retraction or extension strokes.

Please note, the worm gear unit 227 has inherent friction and inertia which aid the one or more system components selected from spring(s), gear train(s), gear transmission(s) and/or cord transmission(s) in counterbalancing the weight of the cover and maintaining the cover in the desired position after extension or retraction. For systems which are of relatively light weight, a worm gear unit by itself may supply sufficient counterbalancing to maintain the cover at the selected positions without spring(s), gear(s), etc.

Typically, bevel gear units are less effective at counterbalancing than are worm gear units and thus bevel gear units are more likely to benefit from or to require a cover system incorporating components such as spring(s), gear(s), etc., which provide counterbalancing.

The present invention has been described in terms of controlling loads in the form of window covering systems. The invention, however, is not limited to the embodiments described and depicted. One familiar with the art to which the present invention pertains will appreciate from the description herein that the present invention is applicable in general to reversibly drive articles, objects or systems, including but not limited to window covers. Adaptation of the system toother loads, in addition to window covers/blinds will be readily done by those of usual skill in the art. The invention is defined by the claims appended hereto.

What is claimed is:

1. A method of selectively moving a window cover in first and second directions by reciprocating a spiral thread follower handle along a spiral rod connected to the window cover, comprising:

first, manually gripping a first section of the handle and translating the handle along the spiral rod in one of two opposite directions to rotate the rod in one of two opposite directions selected by the direction of translation of the handle and thereby move the window cover in a first direction;

second, manually gripping a second section of the handle and translating the handle along the rod in the second of the two opposite directions to move the handle along the rod without rotating the rod and thereby without moving the window cover;

third, manually gripping the first section of the handle and translating the handle along the rod in the second direction to rotate the rod in the second direction and move the window cover in a second direction; and fourth, manually gripping the second section of the handle and translating the handle along the rod in the first direction to move the handle along the rod without rotating the rod and thereby without moving the window cover.

2. The method of claim 1, further comprising, after the first and second steps and prior to the third and fourth steps, employing a fifth step selected from the first, second, third and fourth steps.

3. The method of claim 1, further comprising, repeating the first and second steps as required to move the window cover along the first direction to a selected position, and repeating the third and fourth steps as required to move the window cover along the second direction to a selected position.

4. The method of claim 3, further comprising, after the first and second steps and prior to the third and fourth steps, employing a fifth step selected from the first, second, third and fourth steps.

5. A method for reversibly and repeatedly moving a window cover, comprising:

(a) connecting a window cover to a rod having spiral convolutions;

(b) mounting on the rod a spiral thread follower having a collar extending along the rod and a handle rotatably mounted along the spiral thread follower adjacent to and exposing the collar;

(c) manually gripping the exposed collar to prevent rotation thereof and sliding the handle along the rod in a first direction of translation, thereby rotating the rod in a first direction of rotation, to move the window cover in a first of opening and closing directions;

(d) sliding the handle along the rod in a second direction of translation while releasing the manual gripping force against the collar sufficiently to allow rotation of the collar and the spiral thread follower and thereby position the handle along the rod along the second direction of translation without rotating the rod and without moving the window cover;

(e) manually gripping the exposed collar to prevent rotation thereof and sliding the handle along the rod in the second direction of translation, thereby rotating the rod in the second direction of rotation, to move the window cover in the second of the opening and closing directions; and (f) sliding the handle along the rod in the first direction of translation while releasing the manual gripping force against the collar sufficiently to allow rotation of the collar and the spiral thread follower and thereby position the handle along the rod along the second direction of translation without rotating the rod and without moving the window cover.

6. A method of selectively moving a load in first and second directions by reciprocating a spiral thread follower handle along a spiral rod connected to the load, comprising:

employing first and second steps a plurality of times, the first and second steps comprising:

first, manually gripping a first section of the handle and translating the handle along the spiral rod in one of two opposite directions to rotate the rod in one of two opposite directions selected by the direction of translation of the handle and thereby move the load in a first direction; and second, manually gripping a second section of the handle and translating the handle along the rod in the second of the two opposite directions, to move the handle along the rod without rotating the rod and thereby without moving the load; and employing third and fourth steps a plurality of times, the third and fourth steps comprising:

third, manually gripping the first section of the handle and translating the handle along the rod in the second direction to rotate the rod in the second direction and move the load in a second direction; and fourth, manually gripping the second section of the handle and translating the handle along the rod in the first direction to move the handle along the rod without rotating the rod and thereby without moving the load.

7. The method of claim 6, further comprising, after the first and second steps and prior to the third and fourth steps, employing a fifth step selected from the first, second, third and fourth steps.

8. The method of claim 7, wherein the second step precedes the first step.

9. The method of claim 7, wherein the first step precedes the second step.

10. The method of claim 7, wherein the fourth step precedes the third step.

11. The method of claim 7, wherein the third step precedes the fourth step.

12. The method of claim 7, wherein the second step precedes the first step and the fourth step precedes the third step.

13. The method of claim 7, wherein the second step precedes the first step and the third step precedes the fourth step.

14. The method of claim 7, wherein the first step precedes the second step and the fourth step precedes the third step.

15. The method of claim 7, wherein the first step precedes the second step and the third step precedes the fourth step.

* * * * *